US011298850B2

(12) United States Patent
Sugiyama

(10) Patent No.: US 11,298,850 B2
(45) Date of Patent: Apr. 12, 2022

(54) CUTTING APPARATUS

(71) Applicant: BROTHER KOGYO KABUSHIKI KAISHA, Nagoya (JP)

(72) Inventor: Kentaro Sugiyama, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/039,365

(22) Filed: Sep. 30, 2020

(65) Prior Publication Data

US 2021/0008747 A1 Jan. 14, 2021

Related U.S. Application Data

(63) Continuation of application No. PCT/JP2019/009310, filed on Mar. 8, 2019.

(30) Foreign Application Priority Data

Mar. 30, 2018 (JP) ..... JP2018-067930

(51) Int. Cl.
*B26F 1/38* (2006.01)
*B26D 5/00* (2006.01)
(Continued)

(52) U.S. Cl.
CPC ..... *B26F 1/3826* (2013.01); *B26D 5/005* (2013.01); *B26D 5/083* (2013.01); *B26D 7/2628* (2013.01); *B26D 7/2635* (2013.01)

(58) Field of Classification Search
CPC . B26D 5/083; B26D 5/24; B26D 5/00; B26D 5/005; B26D 5/38; B26D 7/28;
(Continued)

(56) References Cited

U.S. PATENT DOCUMENTS

2012/0266728 A1* 10/2012 Andersen ..... B26D 5/005 83/13
2013/0255458 A1* 10/2013 Kawase ..... B26D 5/005 83/76.1
(Continued)

FOREIGN PATENT DOCUMENTS

JP H02-262995 A 10/1990
JP 2002-127092 A 5/2002
(Continued)

OTHER PUBLICATIONS

International Search Report dated Apr. 23, 2019 in International Application No. PCT/JP2019/001003.
(Continued)

*Primary Examiner* — Nhat Chieu Q Do
(74) *Attorney, Agent, or Firm* — K&L Gates LLP

(57) ABSTRACT

A controller of a cutting apparatus specifies a target position of an attaching portion in a fifth direction and controls a second moving mechanism to move the attaching portion in a third direction. If the controller determines that the attaching portion has reached the target position, the controller executes cutting processing based on the obtained cutting data by controlling the second moving mechanism based on a pressure corresponding value achieved when the attaching portion is located at the target portion. If the controller determines that the pressure corresponding value has reached a pressure threshold, the controller executes the cutting processing by controlling the second moving mechanism based on the pressure corresponding value achieved when the attaching portion is located at a first particular position where the pressure corresponding value is equal to or lower than the pressure threshold value. The controller restarts controlling the second moving mechanism.

13 Claims, 8 Drawing Sheets

(51) Int. Cl.
*B26D 5/08* (2006.01)
*B26D 7/26* (2006.01)

(58) Field of Classification Search
CPC ..... B26D 7/2635; B26D 7/26; B26D 7/2628; B26F 1/3826
USPC ..... 83/76.7, 368; 700/97
See application file for complete search history.

(56) References Cited

U.S. PATENT DOCUMENTS

2014/0000429 A1* 1/2014 Fujihara ..... B26D 5/00 83/76.6
2014/0182432 A1* 7/2014 Muto ..... B26D 5/005 83/76.7
2015/0027285 A1* 1/2015 Okuyama ..... B26F 1/3813 83/72
2015/0120030 A1* 4/2015 Nagai ..... B26D 5/007 700/97
2016/0031109 A1* 2/2016 Abe ..... B26D 7/2614 83/75.5

FOREIGN PATENT DOCUMENTS

JP 2002-172590 A 6/2002
JP 2014-008557 A 1/2014

OTHER PUBLICATIONS

International Preliminary Report on Patentability and English translation of the Written Opinion of the International Searching Authority dated Oct. 6, 2020 in connection with PCT/JP2019/009310.

* cited by examiner

CUTTING APPARATUS

CROSS-REFERENCE TO RELATED APPLICATION

This is a continuation application of International Application No. PCT/JP2019/009310 filed on Mar. 8, 2019 which claims priority from Japanese Patent Application No. 2018-067930 filed on Mar. 30, 2018. The entire contents of the earlier applications are incorporated herein by reference.

TECHNICAL FIELD

Aspects disclosed herein relate to a cutting apparatus that cuts a sheet-like workpiece based on cutting data.

BACKGROUND

A known cutting apparatus cuts out a pattern from a sheet-like workpiece using a cutting blade by moving the workpiece and the cutting blade relative to each other. The cutting apparatus detects a thickness of a workpiece. In a case where a pattern is to be cut out by cutting along the same cut line two or more times because of a thickness of the workpiece, the cutting apparatus accepts an input indicating the number of cuts to be performed on the cut line of the pattern. The cutting apparatus cuts the workpiece the accepted number of times of cutting.

SUMMARY

Nevertheless, in some cases, the accepted number of times of cutting may be improper and this may cause incomplete cuts in a workpiece.

Accordingly, aspects of the disclosure provide a cutting apparatus that may cut a workpiece under a suitable condition for the workpiece.

In one or more aspects of the disclosure, a cutting apparatus may include a platen, an attaching portion, a first moving mechanism, a second moving mechanism, a pressure changer, a sensor, and a controller. The platen may be configured to support a holding member for holding a workpiece. The attaching portion may be configured to hold a cutting blade. The first moving mechanism may be configured to move the holding member supported by the platen and the attaching portion relative to each other in a first direction and a second direction. The second direction may intersect the first direction. The second moving mechanism may be configured to move the attaching portion in a third direction and a fourth direction. The third direction may intersect the first and second directions. The third direction may be a direction in which the second moving mechanism may move the attaching portion toward the platen. The fourth direction may intersect the first and second directions. The fourth direction may be a direction in which the second moving mechanism may move the attaching portion away from the platen. The pressure changer may be configured to change magnitude of pressure to be applied to the attaching portion in the third direction. The sensor may be configured to output a signal indicating a position of the attaching portion in a fifth direction. The fifth direction may include the third direction and the fourth direction. The controller may be configured to control the first moving mechanism and the second moving mechanism. The controller may be configured to execute data obtainment, target position specification, and movement control. The data obtainment may include obtaining cutting data. The target position specification may include specifying a target position of the attaching portion in the fifth direction. The movement control may include controlling the second moving mechanism to move the attaching portion in the third direction. The controller may be further configured to execute first determination while the controller executes the movement control to control the second moving mechanism. The first determination may include determining whether a pressure corresponding value has reached a pressure threshold, the pressure corresponding value corresponding to the magnitude of the pressure applied to the attaching portion in the third direction by the pressure changer. The controller may be further configured to execute second determination while the controller executes the movement control to control the second moving mechanism. The second determination may include determining whether the attaching portion has reached the target position. The controller may be further configured to execute first cutting control in a case where, before the controller determines, in the first determination, that the pressure corresponding value has reached the pressure threshold, the controller determines, in the second determination, that the attaching portion has reached the target position. The first cutting control may include controlling the first moving mechanism based on the obtained cutting data and the second moving mechanism based on the pressure corresponding value achieved when the attaching portion is located at the target portion, thereby executing cutting processing. The cutting processing may include cutting the workpiece using the cutting blade held by the attaching portion by moving the holding member and the attaching portion relative to each other in the first direction and the second direction. The controller may be further configured to execute second cutting control in a case where, before the controller determines, in the second determination, that the attaching portion has reached the target position, the controller determines, in the first determination, that the pressure corresponding value has reached the pressure threshold. The second cutting control may include controlling the first moving mechanism based on the obtained cutting data and the second moving mechanism based on the pressure corresponding value achieved when the attaching portion is located at a first particular position where the pressure corresponding value is equal to or lower than the pressure threshold value, thereby executing the cutting processing. The controller may be further configured to execute third cutting control after executing the second cutting control. The third cutting control may include executing the movement control to restart controlling the second moving mechanism.

According to the one or more aspects of the disclosure, the cutting apparatus may execute the cutting processing for cutting the workpiece under conditions that the attaching portion is located at the target position or at the particular position shifted in the fourth direction from the target position and the pressure corresponding value corresponding to the magnitude of the pressure applied to the attaching portion in the third direction is equal to or less than the threshold. Thus, as compared with a cutting apparatus that leaves out of consideration the pressure applied to the attaching portion in the third direction during execution of the cutting processing, the cutting apparatus according to the one or more aspects of the disclosure may cut the workpiece under the condition suitable for the workpiece.

DETAILED DESCRIPTION

Figure 1:
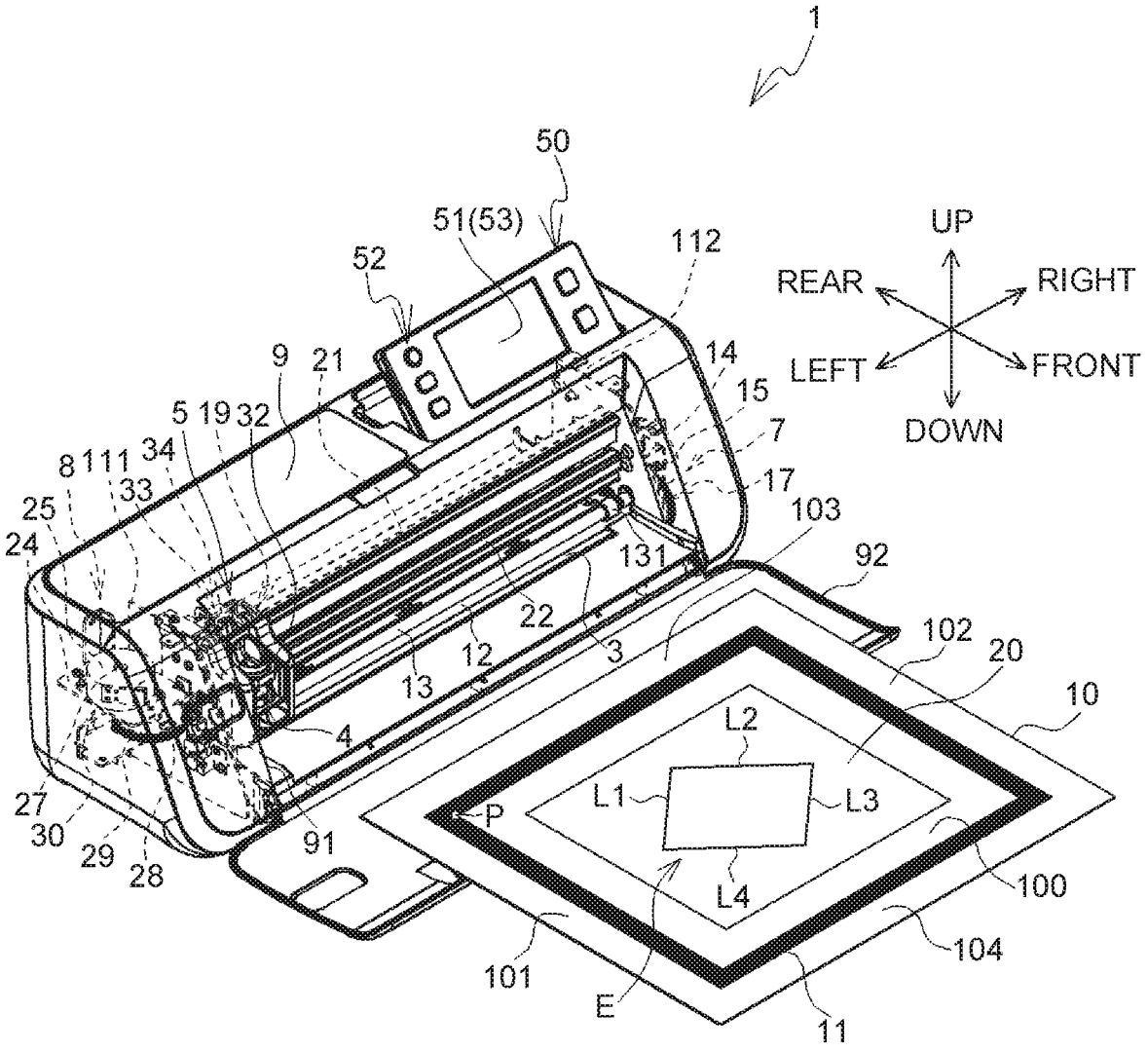
FIG. 1 is a perspective view of a cutting apparatus according to first and second illustrative embodiments of the disclosure.

Illustrative embodiments of the disclosure will be described with reference to the accompanying drawings. The drawings to be referred to are used for explaining technical features employable in the disclosure. Configurations of devices, apparatuses, and systems, and flowcharts of various processing illustrated in the drawings are not intended to limit the disclosure thereto but are merely examples.

Figure 2:
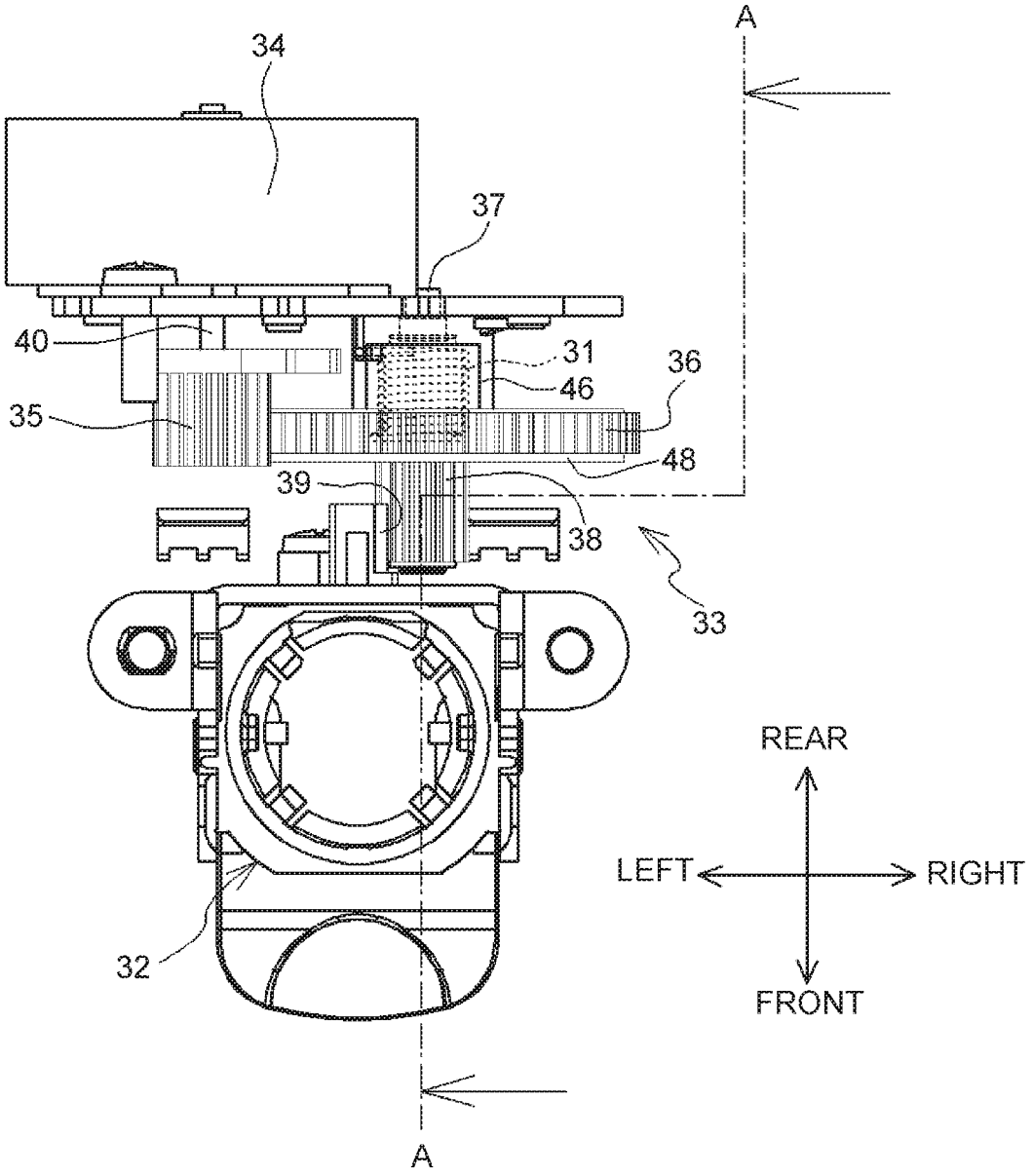
FIG. 2 is a top plan view of an attaching portion and an up-down drive mechanism of the cutting apparatus according to the first and second illustrative embodiments of the disclosure.
Figure 3:
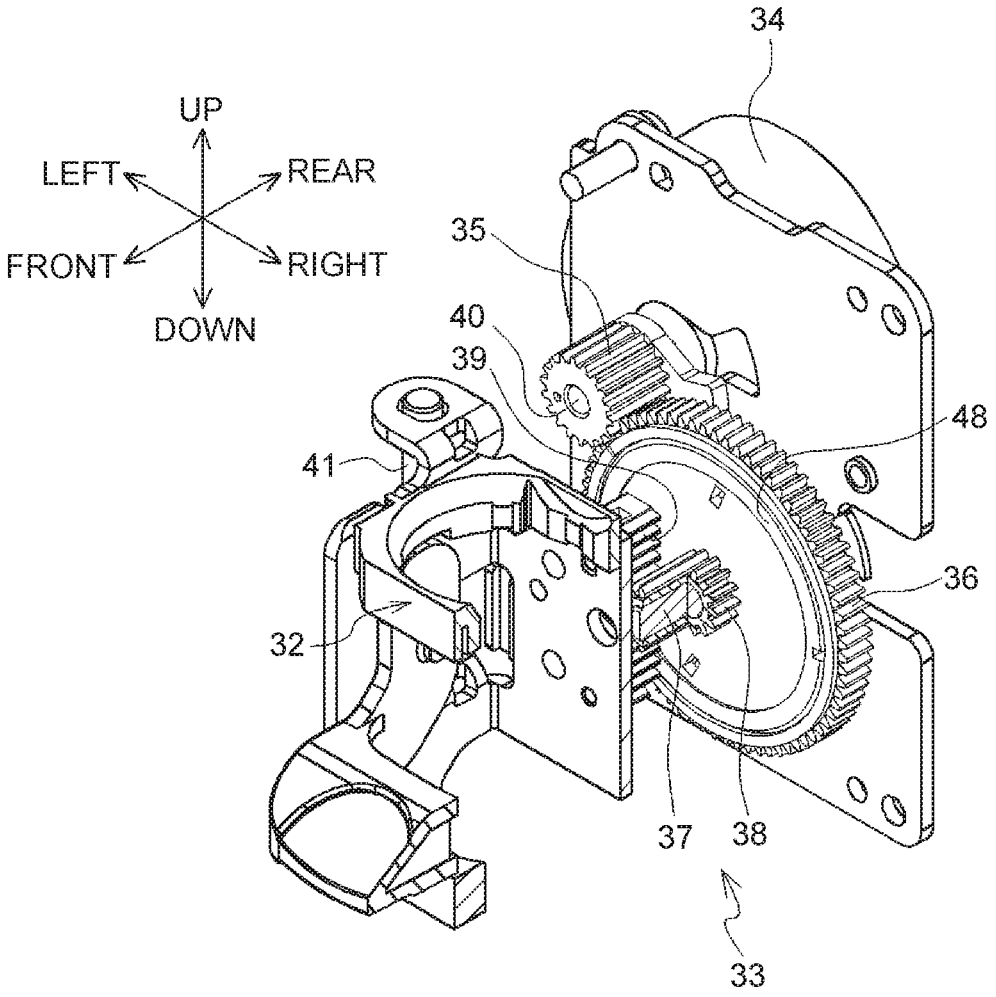
FIG. 3 is a partial sectional perspective view of the attaching portion and the up-down drive mechanism taken along line A-A of FIG. 2 according to the first and second illustrative embodiments of the disclosure.

Referring to FIGS. 1, 2, and 3, a description will be provided on a physical configuration of a cutting apparatus 1 according to first and second illustrative embodiments. In the following description, lower left, upper right, lower right, upper left, upper side, and lower side of the page of FIG. 1 may be defined respectively as left, right, front, rear, upper side and lower side of the cutting apparatus 1. That is, an extending direction of a casing 9 extends corresponds to a right-left direction. A surface of the cutting apparatus 1, in which an operation interface 50 is provided, may be an upper surface of the cutting apparatus 1. A front-rear direction, a right-left direction, a downward direction, an upward direction, and an up-down direction may be also referred to as a first direction, a second direction, a third direction, a fourth direction, and a fifth direction, respectively.

As illustrated in FIG. 1, the cutting apparatus 1 is configured to, based on cutting data, cut out one or more patterns from a sheet-like workpiece 20 held by a holding member 10. The holding member 10 may be a rectangular mat having a certain thickness. The holding member 10 may be made of, for example, synthetic resin. The holding member 10 has a rectangular border 11 printed on its upper surface 18 (e.g., a second surface). The holding member 10 has a cutting area in which the cutting apparatus 1 can cut a workpiece 20. The cutting area may be a substantially rectangular area defined inside the border 11. That is, the cutting area excludes a peripheral portion of the holding member 10 outside the border 11 and the border 11 itself. The peripheral portion of the holding member includes a left end portion 101, a right end portion 102, a rear end portion 103, and a front end portion 104. The holding member 10 has an adhesive coating 100 applied in the cutting area. The adhesive coating 100 is provided by application of adhesive. A workpiece 20 may be a sheet-like member such as a cloth or a sheet of paper having a front surface 23 and a back surface opposite to the front surface 23. A workpiece 20 may be held by the holding member 10 such that the front surface 23 (e.g., a first surface) of the workpiece 20 faces upward and the back surface of the workpiece 20 is adhered to the upper surface 18 (e.g., the second surface) of the holding member 10 via the adhesive coating 100. The front surface 23 (e.g., the first surface) of the workpiece 20 may face an attaching portion 32 in the fifth direction during execution of cutting processing. The cutting apparatus 1 includes the casing 9, a platen 3, ahead 5, a conveying mechanism 7, and a head moving mechanism 8. The conveying mechanism 7 and the head moving mechanism 8 are an example of a first moving mechanism.

The casing 9 may have a substantially box-like shape elongated in the right-left direction. The casing 9 includes an opening 91, a cover 92, and the operation interface 50. The casing 9 has the opening 91 at its front portion. The cover 92 may be a plate-like member elongated in the right-left direction. The cover 92 has a lower end pivotably supported by the casing 9. The cover 92 is configured to be opened to uncover the opening 91. The cover 92 is further configured to be closed to cover the opening 91. In FIG. 1, the cover 92 is opened to uncover the opening 91.

The operation interface 50 is disposed at a right portion of the upper surface of the casing 9. The operation interface 50 includes a liquid crystal display ("LCD") 51, a plurality of operating buttons 52, and a touch screen 53. The LCD 51 is configured to display images representing various items such as commands, illustrations, setting values, and messages. The touch screen 53 is disposed on a surface of the LCD 51. A user is enabled to press the touch screen 53 with a finger or stylus. Hereinafter, such a user's operation is referred to as a touch-screen operation. The cutting apparatus 1 is configured to determine, based on a pressed position detected by the touch screen 53, an item that has been selected. The user is enabled to, for example, select one or more patterns from various patterns displayed on the LCD 51, specify parameters, and input instructions, using one or more of the operating buttons 52 and the touch screen 53.

The platen 3 is disposed inside the casing 9. The platen 3 may be a plate-like member elongated in the right-left direction. The platen 3 is configured to receive a lower surface of the holding member 10 and support the holding member 10 that may hold a workpiece 20. In a state where the cover 92 is opened to uncover the opening 91, the holding member 10 is allowed to be placed on the platen 3.

The head 5 includes a carriage 19, the attaching portion 32, a sensor 41, and an up-down drive mechanism 33. The up-down drive mechanism 33 is an example of a second moving mechanism. The attaching portion 32 and the up-down drive mechanism 33 are disposed on opposite sides of the carriage 19 in the front-rear direction. The attaching portion 32 is configured to hold a cartridge 4 having a cutting blade 16 (refer to FIG. 6). The cartridge 4 is configured to, in a state where the cartridge 4 has the cutting blade 16 at its lower end, be detachably attached to the attaching portion 32. The sensor 41 may be a position sensor configured to output a signal indicating the position of the attaching portion 32 in the fifth direction (hereinafter, also simply referred to as a fifth-direction position of the attaching portion 32). As illustrated in FIG. 3, the sensor 41 is disposed to the left rear of the attaching portion 32.

The up-down drive mechanism 33 is configured to move the attaching portion 32 in the third direction and the fourth direction. The third direction and the fourth direction may each be orthogonal to the first direction and the second direction. The third direction may be a direction in which the up-down drive mechanism 33 moves the attaching portion 32 toward the platen 3. The fourth direction may be a direction in which the up-down drive mechanism 33 moves the attaching portion 32 away from the platen 3. In the illustrative embodiments, the up-down drive mechanism 33 includes a Z-axis motor 34 and a transmission unit connected to an output shaft 40 of the Z-axis motor 34. The up-down drive mechanism 33 is configured such that the transmission unit decelerates rotating motion of the Z-axis motor 34, converts the rotating motion into up-down motion, and transmits the up-down motion to the attaching portion 32, thereby driving the attaching portion 32 and the cartridge 4 in the fifth direction (hereinafter, also referred to as a Z-axis direction). That is, the Z-axis motor 34 is configured to drive the attaching portion 32 and the cartridge 4 in the fifth direction. As illustrated in FIGS. 2 and 3, the up-down drive mechanism 33 includes gears 35 and 36, a shaft 37, a plate member 48, a pinion 38, and a rack 39 that constitute the transmission unit of the up-down drive mechanism 33. The gear 35 is fixed to a front end portion of the output shaft 40 of the Z-axis motor 34. The gear 35 is in mesh with the gear 36. The gear 35 has a diameter smaller than a diameter of the gear 36. The gear 36 includes a tubular shaft 46 extending in the front-rear direction. The shaft 37 extends through the tubular shaft 46 of the gear 36. The output shaft 40 of the Z-axis motor 34 and the shaft 37 both extend in the front-rear direction.

The plate member 48 may have a disc-like shape having a diameter slightly smaller than the diameter of the gear 36. The plate member 48 has a front surface connected to a rear end of the pinion 38. The plate member 48 and the pinion 38 are in one piece and inseparable from each other. The plate member 48 and the gear 36 are separate components. The plate member 48 and the pinion 38 are configured to rotate independently of rotation of the gear 36. The pinion 38 and the plate member 48 are disposed further to the front than the gear 36. The shaft 37 extends through the pinion 38 and the plate member 48. The pinion 38 and the plate member 48 are configured to rotate relative to the shaft 37. The pinion 38 has a diameter smaller than the respective diameters of the gears 35 and 36. The rack 39 extends in the up-down direction and has teeth on its right surface. The rack 39 is in mesh with the pinion 38 via their interlocking teeth. The rack 39 is fixed to the back of the attaching portion 32.

The up-down drive mechanism 33 further includes a pressure changer 31. The pressure changer 31 is configured to change magnitude of pressure applied to the attaching portion 32 in the third direction (e.g., a downward pressure applied to the attaching portion 32) (hereinafter, simply referred to as a third-direction pressure). In the illustrative embodiments, the pressure changer 31 may be, for example, a torsion spring disposed in the shaft 46 of the gear 36. The pressure changer 31 has one end fixed to the shaft 46 and the other end fixed to the plate member 48. The pressure changer 31 is configured to transmit rotation of the gear 36 to the plate member 48. The pressure changer 31 is further configured to, in response to change of a compression amount of the torsion spring serving as the pressure changer 31 in accordance with rotation of the gear 36, change magnitude of a third-direction pressure applied to the attaching portion 32. In other words, in accordance with rotation of the shaft 46 due to rotation of the gear 36, the compression amount of the torsion spring serving as the pressure changer 31 whose one end is connected to the shaft 46 changes. Thus, a rotation force of the plate member 48 to which the other end of the pressure changer 31 is connected changes. In response to change of the rotation force of the plate member 48, the third-direction pressure applied to the attaching portion 32 changes.

As the output shaft 40 of the Z-axis motor 34 rotates clockwise, the gear 35 rotates clockwise and the gear 36 rotates counterclockwise. In response, the pressure changer 31 transmits rotation of the gear 36 to the plate member 48. In a state where the cutting blade 16 is out of contact with a workpiece 20 or the holding member 10, pressure acting in the fourth direction (hereinafter, simply referred to as a fourth-direction pressure) (e.g., an upward pressure) does not exert on the attaching portion 32. Thus, in response to receiving rotation of the gear 36 transmitted from the pressure changer 31, the plate member 48 and the pinion 38 rotate counterclockwise respectively by an amount corresponding to the rotation of the gear 36. In a state where the cutting blade 16 is in contact with a workpiece 20 or the holding member 10, the attaching portion 32 receives a fourth-direction pressure via the cutting blade 16. Thus, even when the plate member 48 receives rotation of the gear 36 transmitted from the pressure changer 31, the plate member 48 and the pinion 38 do not rotate unless the third-direction pressure applied to the attaching portion 32 exceeds the fourth-direction pressure applied to the attaching portion 32. As the output shaft 40 of the Z-axis motor 34 rotates clockwise in such a state, the gear 36 rotates relative to the plate member 48 and the pinion 38 and torsion of the pressure changer 31 increases. In response to this, the third-direction pressure applied to the attaching portion 32 by the pressure changer 31 via the plate member 48 and the pinion 38 increases. In a case where the third-direction pressure applied to the attaching portion 32 by the pressure changer 31 exceeds the fourth-direction pressure applied to the attaching portion 32, the pinion 38 starts rotating and the attaching portion 32 moves in the third direction. The rotation amount of the pinion 38 may differ from or may be equal to the rotation amount of the gear 36. As the output shaft 40 of the Z-axis motor 34 rotates counterclockwise, the gear 35 rotates counterclockwise and the gear 36 and the pinion 38 rotate clockwise. At that time, the attaching portion 32 moves in the fourth direction together with the rack 39. The cartridge 4 attached to the attaching portion 32 moves between a cutting position and a raised position in accordance with driving of the Z-axis motor 34. The cutting position is to be determined in cutting processing. The cutting position refers to a particular position of the attaching portion 32 in the fifth direction when the cutting apparatus 1 performs cutting on a workpiece 20 based on cutting data. The raised position refers to another particular position of the attaching portion 32 in the fifth down direction where the attaching portion 32 is spaced from a workpiece 20 by a predetermined distance in the fifth direction.

The rotation amount of the Z-axis motor 34 is in correlation to a third-direction pressure applied to the attaching portion 32 by the pressure changer 31 in a case where the cutting blade 16 contacts a workpiece 20 or the holding member 10. In the illustrative embodiments, the Z-axis motor 34 may be a pulse motor, and a rotation angle of the output shaft 40 of the Z-axis motor 34 is proportional to a pulse input to the Z-axis motor 34. Thus, the number of pulses input to the Z-axis motor 34 is in correlation to pressure acting toward the platen 3 applied to the attaching portion 32 by the pressure changer 31. In the illustrative embodiments, the number of pulses input to the Z-axis motor 34 is used as a pressure corresponding value that corresponds to the magnitude of a third-direction pressure applied to the attaching portion 32 by the pressure changer 31.

The conveying mechanism 7 and the head moving mechanism 8 are configured to respectively move the holding member 10 placed on the platen 3 and the attaching portion 32 relative to each other in the first direction and the second direction orthogonal to the first direction. The conveying mechanism 7 is configured to convey the holding member 10 placed on the platen 3 in the front-rear direction (hereinafter, also referred to as a Y-axis direction) in the cutting apparatus 1. The conveying mechanism 7 includes a drive roller 12, a pinch roller 13, a mount frame 14, a Y-axis motor 15, and a decelerator 17. The casing 9 further includes therein inner walls 111 and 112 facing each other. The inner wall 111 is disposed to the left of the platen 3. The inner wall 112 is disposed to the right of the platen 3. The drive roller 12 and the pinch roller 13 are disposed between and rotatably supported by the inner walls 111 and 112. The drive roller 12 and the pinch roller 13 are configured to convey the holding member 10 in the first direction (e.g., the Y-axis direction) relative to the attaching portion 32. The drive roller 12 and the pinch roller 13 both extend in the right-left direction (hereinafter, also referred to as an X-axis direction) of the cutting apparatus 1, and disposed next to each other in the up-down direction. The pinch roller 13 includes a roller portion at its left end portion and a roller portion 131 at its right end portion.

The inner wall 112 has opposite surfaces in the right-left direction. The left surface of the inner wall 112 faces the inner wall 111. The mount frame 14 is fixed to the right surface of the inner wall 112. The Y-axis motor 15 is mounted to the mount frame 14. The Y-axis motor 15 may be, for example, a pulse motor. The Y-axis motor 15 includes an output shaft connected to a drive gear of the decelerator 17. The drive gear of the decelerator 17 is in mesh with a driven gear. The driven gear is fixed to a right end of the drive roller 12.

When the conveying mechanism 7 conveys the holding member 10, the drive roller 12 and the left roller portion of the pinch roller 13 pinch therebetween the left end portion 101 of the holding member 10 and the drive roller 12 and the right roller portion 131 of the pinch roller 13 pinch therebetween the right end portion 102 of the holding member 10. In response to the Y-axis motor 15 rotating in a forward direction or in a reverse direction, the rotating motion of the Y-axis motor 15 is transmitted to the drive roller 12 via the decelerator 17. That is, the Y-axis motor 15 drives the drive roller 12. The holding member 10 is thus conveyed frontward or backward in a conveyance direction in accordance with the rotating direction of the Y-axis motor 15.

The head moving mechanism 8 is configured to move the head 5 in a direction intersecting the conveyance direction of the holding member 10, that is, in the X-axis direction. In other words, the moving direction of the head 5 is orthogonal to the conveyance direction of the holding member 10. The head moving mechanism 8 includes a pair of upper and lower guide rails 21 and 22, a mount frame 24, an X-axis motor 25, a drive gear 27, a driven gear 29, and a transmission mechanism 30. The drive gear 27 and the driven gear 29 constitute a decelerator. The guide rails 21 and 22 are fixed between the inner walls 111 and 112. The guide rails 21 and 22 are disposed above to the rear of the pinch roller 13. The guide rails 21 and 22 both extend substantially parallel to the pinch roller 13, that is, extend in the X-axis direction. The carriage 19 of the head 5 is supported by the guide rails 21 and 22 so as to be movable in the X-axis direction along the guide rails 21 and 22.

The inner wall 111 has opposite surfaces in the right-left direction. The right surface of the inner wall 111 faces the inner wall 112. The mount frame 24 is fixed to the left surface of the inner wall 111. The X-axis motor 25 is disposed at a rear portion of the mount frame 24 and faces downward. The drive gear 27 is fixed to an output shaft of the X-axis motor 25. The X-axis motor 25 may be, for example, a pulse motor. The driven gear 29 is in mesh with the drive gear 27. The transmission mechanism 30 includes a pair of right and left timing pulleys including a timing pulley 28, and an endless timing belt looped around the timing pulleys. The timing pulley 28 (e.g., the left timing pulley) is disposed at the mount frame 24 so as to be rotatable together with the driven gear 29. The other timing pulley (e.g., the right timing pulley) is disposed at the mount frame 14. The timing belt extends in the X-axis direction and is connected to the carriage 19.

The head moving mechanism 8 is configured to convert rotating motion of the X-axis motor 25 into linear motion in the X-axis direction and transmit the linear motion to the carriage 19. In response to the X-axis motor 25 rotating in a forward direction or in a reverse direction, the rotating motion of the X-axis motor 25 is transmitted to the timing belt via the drive gear 27, the driven gear 29, and the timing pulley 28. The carriage 19 thus moves leftward or rightward correspondingly. Thus, the head 5, and more specifically, the attaching portion 32, moves in the second direction (e.g., the X-axis direction) relative to the holding member 10 by driving of the X-axis motor 25.

Figure 4:
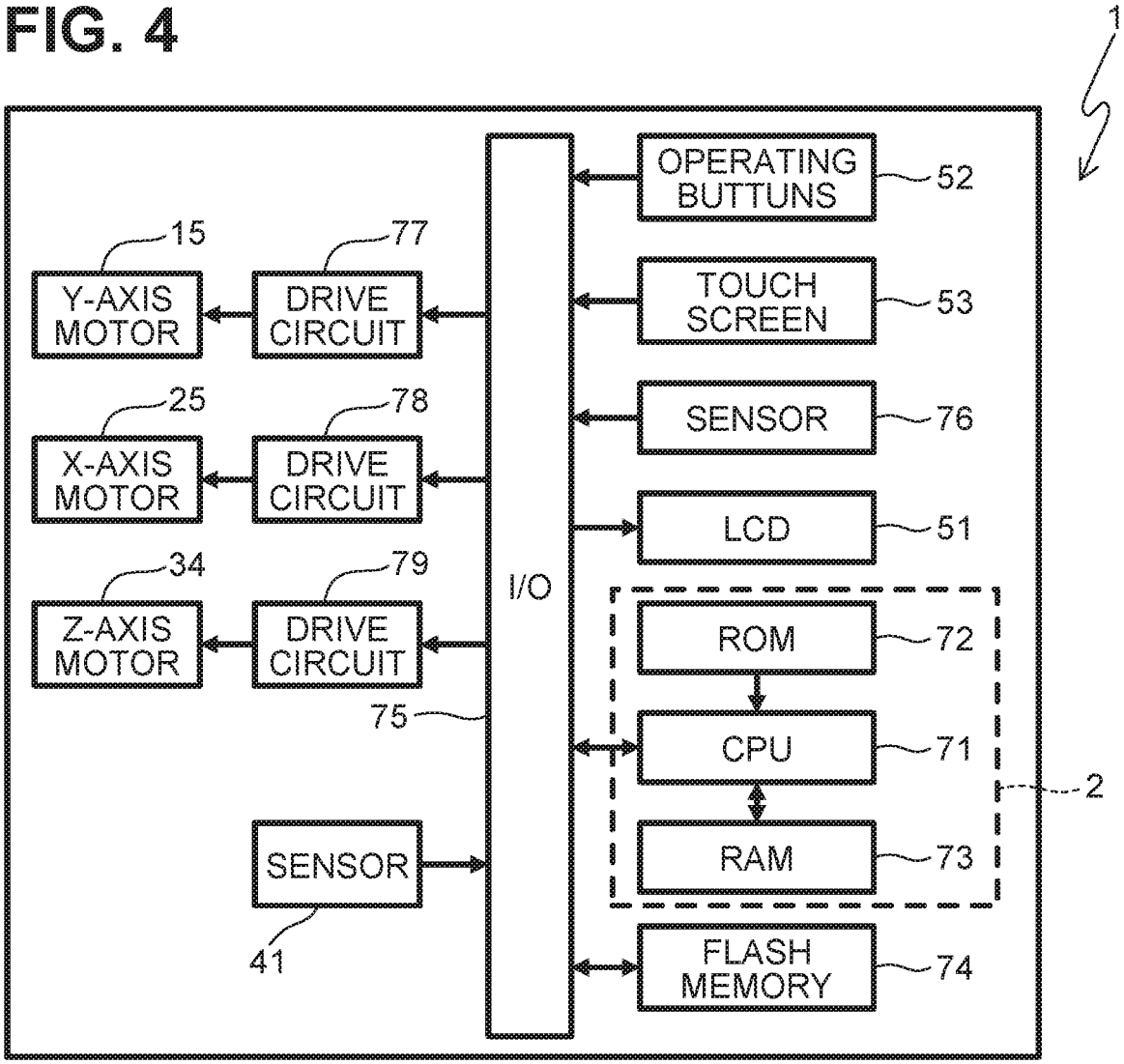
FIG. 4 is a block diagram of an electrical configuration of the cutting apparatus according to the first and second illustrative embodiments of the disclosure.

Referring to FIG. 4, a description will be provided on an electrical configuration of the cutting apparatus 1 according to the first and second illustrative embodiments. The cutting apparatus 1 includes a CPU 71, a ROM 72, a RAM 73, and an input/output ("I/O") interface 75. The CPU 71 is electrically connected to the ROM 72, the RAM 73, and the I/O interface 75. The CPU 71, the ROM 72, and the RAM 73 serve as a controller 2 that mainly controls the cutting apparatus 1. The ROM 72 stores various programs for operating the cutting apparatus 1. The programs include, for example, a program for enabling the cutting apparatus 1 to execute main processing. The RAM 73 is configured to temporarily store various programs and data, setting values input using one or more of the operating buttons 52, and calculation results obtained by the CPU 71 in calculation processing.

A flash memory 74, the operating buttons 52, the touch screen 53, a sensor 76, the sensor 41, the LCD 51, and drive circuits 77, 78, and 79 are connected to the I/O interface 75. The flash memory 74 may be a nonvolatile storage device that stores, for example, various parameters.

The sensor 76 is configured to detect a leading end of the holding member 10 set on the platen 3 to output a detection signal. A detection signal output by the sensor 76 is input to the controller 2. The sensor 41 is configured to output a signal indicating the position of the attaching portion 32 in the fifth direction. In the illustrative embodiments, the controller 2 is configured to determine, based on an output of the sensor 41, the position of the attaching portion 32 with reference to the position of an upper surface of the platen 3. Nevertheless, in other embodiments, for example, another suitable reference may be used for determining the position of the attaching portion 32 in the fifth direction. The controller 2 is configured to control the LCD 51 to display one or more images thereon. The LCD 51 is configured to display thereon various instructions. The drive circuits 77, 78, and 79 are configured to drive the Y-axis motor 15, the X-axis motor 25, and the Z-axis motor 34, respectively. The controller 2 is further configured to, based on cutting data, control the Y-axis motor 15, the X-axis motor 25, and the Z-axis motor 34 to perform automatic cutting on a workpiece 20 placed on the holding member 10. The cutting data includes coordinate data used for controlling the conveying mechanism 7 and the head moving mechanism 8. The coordinate data may be represented by a cutting coordinate system defined within the cutting area. In the illustrative embodiments, the origin of the cutting coordinate system may be a point P located at a left-rear corner of the rectangular cutting area. The right-left direction and the front-rear direction may be defined as the X-axis direction and the Y-axis direction, respectively.

Figure 5:
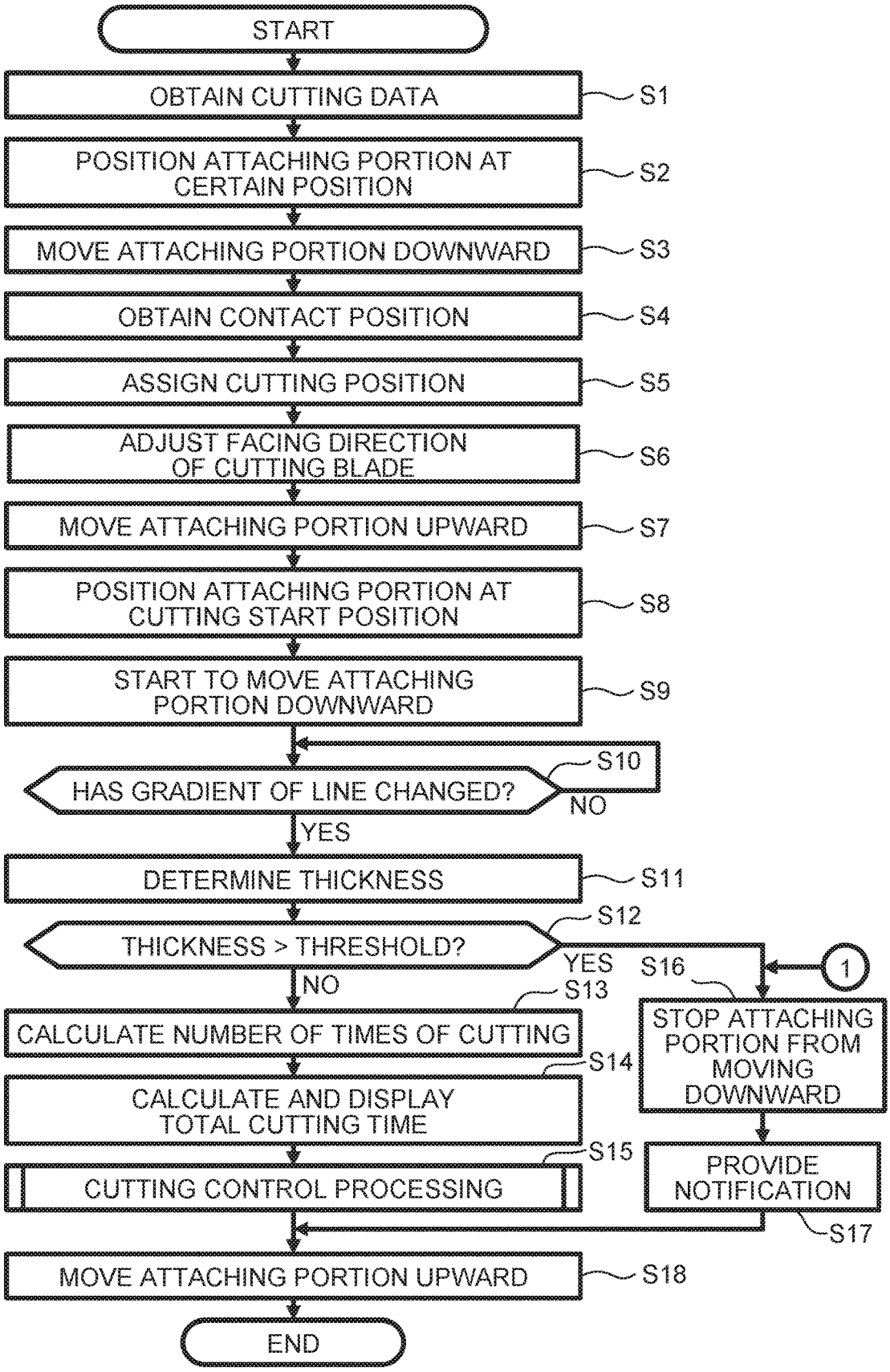
FIG. 5 is a flowchart of main processing according to the first illustrative embodiment of the disclosure.
Figure 6A:
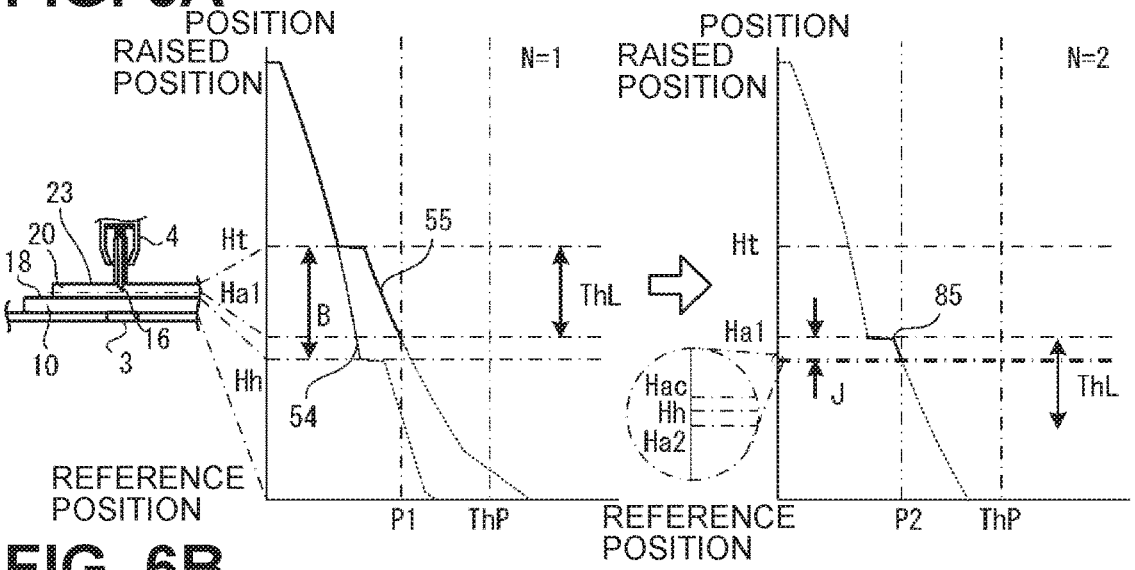
FIGS. 6A, 6B, 6C are graphs each representing change in position of the attaching portion in an up-down direction with respect to a pressure corresponding value corresponding to magnitude of pressure applied to a workpiece according to the first and second illustrative embodiments of the disclosure.
Figure 6B:
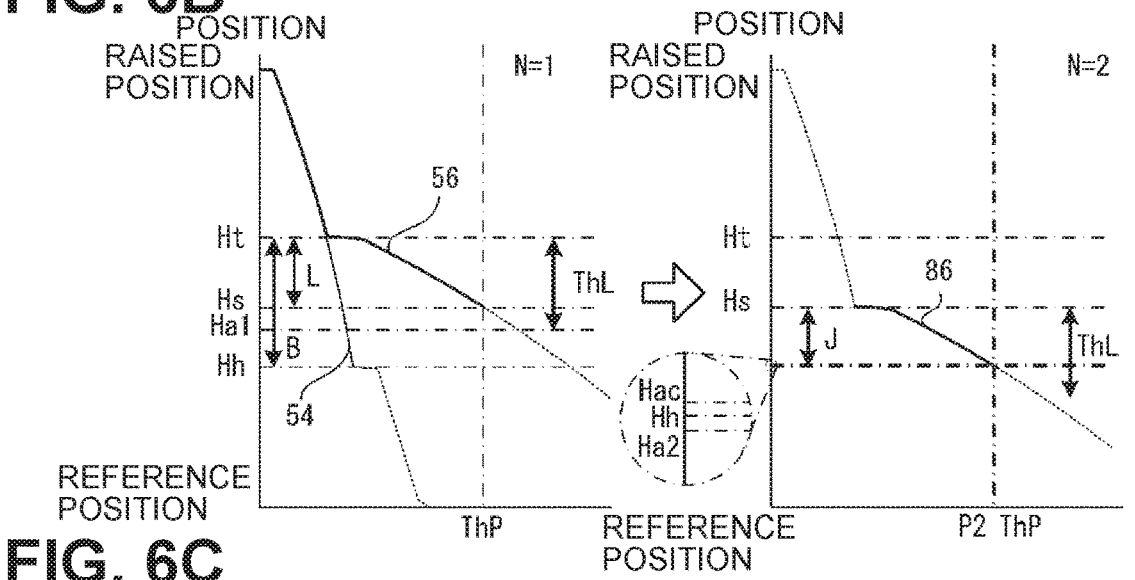
Figure 6C:
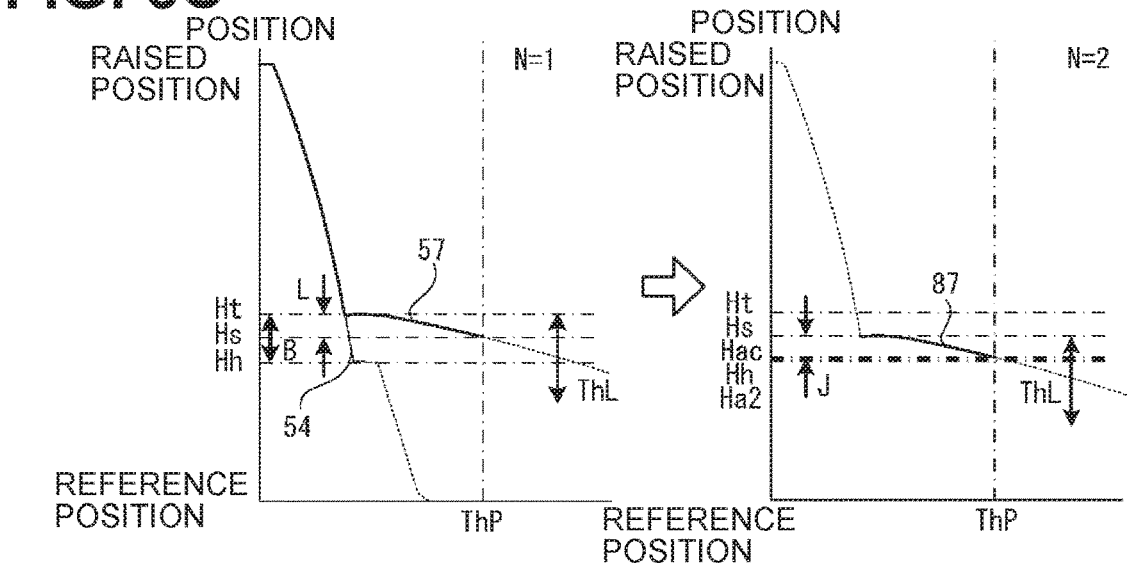
Figure 7:
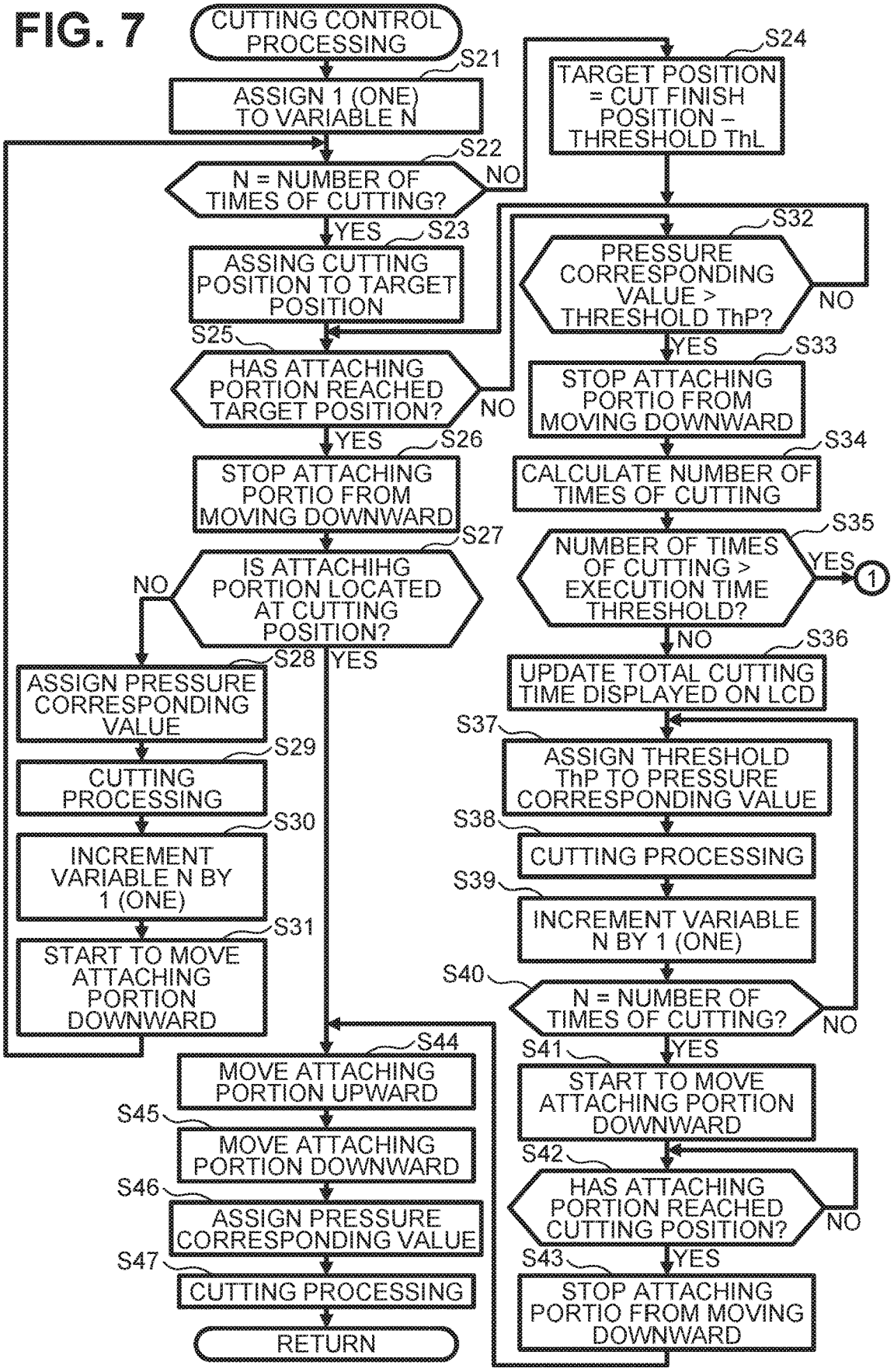
FIG. 7 is a flowchart of cutting control processing executed in the main processing of FIG. 5 according to the first illustrative embodiment of the disclosure.

Referring to FIGS. 5, 6, and 7, a description will be provided on the main processing according to the first illustrative embodiment. In response to receiving a start instruction by a touch-screen operation, the controller 2 of the cutting apparatus 1 reads out a certain program from the flash memory 74 to store the read program in the RAM 73 and executes the main processing in accordance with instructions included in the read program. A description will be provided on first to third examples in each of which a pattern E (refer to FIG. 1) is cut out in a workpiece 20. The position of the attaching portion 32 in the fifth direction (e.g., in the up-down direction) corresponding to a pressure corresponding value is indicated by a legend 55 in the right graph of FIG. 6A in the first example, a legend 56 in the right graph of FIG. 6B in the second example, and a legend 57 in the right graph of FIG. 6C in the third example. In FIGS. 6A, 6B, and 6C, a solid line indicates a relationship between the position of the attaching portion 32 in the fifth direction and a pressure corresponding value obtained in the main processing, and a dashed line indicates reference values of a relationship between the position of the attaching portion 32 in the fifth direction and a pressure corresponding value not obtained in the main processing. As illustrated in FIG. 1, for example, the pattern E may be a quadrilateral pattern including line segments L1, L2, L3, and L4. Although the main processing is executed at respective different timings in the first, second, and third examples, they will be described in parallel for the sake of simplicity. Various thresholds used in the main processing may be predetermined in consideration of cutting conditions or may be specified by the user.

As illustrated in FIG. 5, in the main processing, the controller 2 obtains cutting data (e.g., step S1). In each of the first to third examples, the controller 2 obtains cutting data for cutting out the pattern E in the workpiece 20. Subsequent to step S1, the controller 2 controls the drive circuits 77 and 78 to drive the Y-axis motor 15 and the X-axis motor 25, respectively, to control the conveying mechanism 7 and the head moving mechanism 8, thereby moving the attaching portion 32 relative to the holding member 10 to stop at a certain position (e.g., step S2). The controller 2 executes step S2 in a state where the cutting blade 16 attached to the attaching portion 32 is out of contact with the holding member 10 placed on the platen 3. In the first illustrative embodiment, the certain position may be an adjusting position in which known adjustment processing for adjusting a facing direction of a blade edge is executed. More specifically, for example, the certain position is included in an adjusting area that may be on a rear side of the border 11.

Subsequent to step S2, the controller 2 controls the up-down drive mechanism 33 to move the attaching portion 32 downward toward the platen 3 in the certain position where the attaching portion 32 has been located in step S2 (e.g., step S3) and obtains a contact position (e.g., step S4). The contact position may refer to the position of the attaching portion 32 in the fifth position corresponding to a signal output by the sensor 41 when the cutting blade 16 contacts the holding member 10. More specifically, the controller 2 counts, as the pressure corresponding value, pulses input to the Z-axis motor 34 (i.e., the drive circuit 79) while moving the attaching portion 32 in the third direction. The controller 2 obtains, based on a signal output by the sensor 41, the position of the attaching portion 32 relative to the pressure corresponding value. In each of the right graphs of FIGS. 6A, 6B, and 6C, a legend 54 indicates a relationship between the position of the attaching portion 32 in the fifth direction in the certain position and the pressure corresponding value (e.g., the number of pulses input to the Z-axis motor 34). As illustrated in FIGS. 6A to 6C, each graph includes a position Hh at which a gradient of a line indicating the position of the attaching portion 32 relative to the pressure corresponding value changes. In the first illustrative embodiment, the controller 2 moves the attaching portion 32 toward the platen 3 to obtain, as the contact position, the position Hh at which the gradient of the line indicating the position of the attaching portion 32 in the fifth direction relative to the pressure corresponding value changes. The position Hh corresponds to the position of the upper surface 18 of the holding member 10 in the fifth direction. In response to detecting the change of the gradient of the line, the controller 2 controls the up-down drive mechanism 33 to stop the attaching portion 32 from moving in the third direction.

Subsequent to step S4, the controller 2 assigns a cutting position based on the obtained contact position (e.g., step S5). In the first illustrative embodiment, the controller 2 assigns a particular position to the cutting position. The particular position may be shifted in the third direction from the contact position obtained in step S4 by a certain distance less than a thickness (e.g., a dimension in the up-down direction) of the holding member 10. The thickness of the holding member 10 may be obtained based on output of the sensor 41 or prestored in the flash memory 74. The thickness of the holding member 10 may be, for example, 4.0 mm. The certain distance used in step S5 may be prestored in the flash memory 74 or may be specified by the user. The certain distance may be, for example, 1.0 mm.

Subsequent to step S5, in a state where the cutting blade 16 is in contact with the holding member 10 by execution of step S3, the controller 2 controls the conveying mechanism 7 and the head moving mechanism 8 to adjust the facing direction of the cutting blade 16 within the adjusting area in the known manner (e.g., step S6). Subsequent to step S6, the controller 2 controls the up-down drive mechanism 33 to move the attaching portion 32 upward (e.g., in the fourth direction) to stop at the raised position (e.g., step S7). The controller 2 controls, based on the cutting data obtained in step S1, the conveying mechanism 7 and the head moving mechanism 8 to respectively move the holding member 10 and the attaching portion 32 relative to each other to position the holding member 10 and the attaching portion 32 at a cutting start position (e.g., step S8). At the cutting start position, the attaching portion 32 faces the workpiece 20 held by the holding member 10. More specifically, for example, the controller 2 controls the conveying mechanism 7 and the head moving mechanism 8 to respectively move the attaching portion 32 and the holding member 10 relative to each other to position the cutting blade 16 above a point of intersection of the line segments L1 and L2.

Subsequent to step S8, the controller 2 controls the up-down drive mechanism 33 to start to move the attaching portion 32 in the third direction (e.g., downward) in the cutting start position (e.g., step S9). More specifically, the controller 2 counts, as the pressure corresponding value, pulses input to the Z-axis motor 34 (i.e., the drive circuit 79) while moving the attaching portion 32 in the third direction. The controller 2 obtains, based on a signal output by the sensor 41, the position of the attaching portion 32 relative to the pressure corresponding value. Subsequent to step S9, the controller 2 determines, based on output of the sensor 41, whether the gradient of the line indicating the position of the attaching portion 32 relative to the pressure corresponding value has changed (e.g., step S10). In each of the right graphs of FIGS. 6A, 6B, and 6C, a legend 55, 56, or 57 indicates a relationship between the position of the attaching portion 32 in the fifth direction in the cutting start position and the pressure corresponding value (e.g., the number of pulses input to the Z-axis motor 34). As illustrated in FIGS. 6A to 6C, each graph includes a position Ht at which the gradient of the line indicating the position of the attaching portion 32 relative to the pressure corresponding value changes. In the first illustrative embodiment, the controller 2 moves the attaching portion 32 toward the platen 3 to obtain the position Ht at which the gradient of the line indicating the position of the attaching portion 32 in the fifth direction relative to the pressure corresponding value changes. The controller 2 determines, based on the obtained position Ht, a thickness B of the workpiece 20 (e.g., step S11). The position Ht corresponds to the position of the front surface 23 of the workpiece 20 in the fifth direction. The controller 2 determines the position Hh corresponding to the position of the upper surface 18 of the holding member 10 and the position Ht corresponding to the position of the front surface 23 of the workpiece 20, and determines the thickness B of the workpiece 20 based on a difference between the position Hh and the position Ht.

Subsequent to step S11, the controller 2 determines whether the thickness B determined in step S11 is greater than a threshold Th (e.g., step S12). The threshold Th is specified in consideration of, for example, a size of the cutting blade 16 and a movable range of the attaching portion 32 in the fifth direction. The threshold Th may be, for example, 4.0 mm. In the first illustrative embodiment, if the thickness B determined in step S11 is greater than the threshold Th, the cutting apparatus 1 does not execute the cutting processing. If the thickness B determined in step S11 is greater than the threshold Th (e.g., YES in step S12), the controller 2 controls the up-down drive mechanism 33 to stop the attaching portion 32 from moving in the third direction (e.g., downward) (e.g., step S16). Subsequent to step S16, the controller 2 provides notification that the thickness B of the workpiece 20 is greater than the threshold Th (e.g., step S17). More specifically, the controller 2 controls the LCD 51 to display thereon an error message indicating, for example, that the thickness of the workpiece exceeds the limit. Subsequent to step S17, the controller 2 controls the up-down drive mechanism 33 to move the attaching portion 32 in the fourth direction (e.g., upward) to stop at the raised position (e.g. step S18). In response to the completion of step S18, the main processing ends.

If the controller 2 determines that the thickness B determined in step S11 is equal to or less than the threshold Th (e.g., NO in step S12), the controller 2 calculates the number of times of cutting (e.g., step S13). The number of times of cutting refers to how many times a series of steps included in the cutting processing need to be executed to cut out a pattern in the workpiece 20 based on the cutting data obtained in step S1. In the cutting processing, the controller 2 sequentially reads out coordinate data included in the cutting data and controls the conveying mechanism 7 and the head moving mechanism 8 to cut out the pattern E in the workpiece 20 using the cutting blade 16. One-time execution of the cutting processing includes the series of the steps including sequentially reading out all coordinate data included in cutting data and controlling the conveying mechanism 7 and the head moving mechanism 8 based on all the read coordinate data. That is, in a case where the cutting apparatus 1 cuts all line segments of a pattern indicated by the cutting data once, the number of times of cutting is counted as one time. The controller 2 calculates the number of times of cutting by dividing the thickness B determined in step S11 by a thickness threshold (e.g., a threshold ThL) and rounding the result of the division up to the next whole number. The threshold ThL indicates an upper limit of a thickness of a workpiece 20 that can be cut in one time execution of the cutting processing. The threshold ThL may be, for example, 1.0 mm. The number of times of cutting is calculated as two times in both the first and second examples, and as one time in the third example. Subsequent to step S13, the controller 2 calculates a total cutting time based on the number of times of cutting calculated in step S13 and controls the LCD 51 to display thereon the calculated total cutting time (e.g., step S14). The total cutting time may be obtained by multiplying a time period required for completing the cutting processing one time (hereinafter, simply referred to as a processing duration T) by the number of times of cutting calculated in step S13. The processing duration T may be obtained by multiplying a total length of line segments to be cut represented by the cutting data obtained in step S1 by a cut length that can be cut per unit time. The processing duration T may include a time period required for moving the attaching portion 32 up and down. The total cutting time is calculated as 2 T in both the first and second examples, and as T in the third example.

Subsequent to step S14, the controller 2 executes cutting control processing (e.g., step S15). As illustrated in FIG. 7, in the cutting control processing, the controller 2 assigns 1 (one) to a variable N (e.g., step S21). The variable N is used for changing the value for the number of times of cutting. Subsequent to step S21, the controller 2 determines whether the value of the variable N is equal to the number of times of cutting calculated in step S13 (e.g., step S22). If the value of the variable N is assigned 1 (one) in step S21, in each of the first and second examples, the controller 2 determines that the value of the variable N is not equal to the number of times of cutting (e.g., NO in step S22). In such a case, the controller 2 assigns a position Ha1 to a target position (e.g., step S24). The target position may be obtained by subtracting the threshold ThL from a cut finish position. The cut finish position corresponds to the position of a lower end of a cut formed in the workpiece 20 in the fifth direction by executing of the cutting processing. If the value of the variable N is assigned 1 (one) in step S21, the controller 2 has not executed the cutting processing on the workpiece 20. Thus, the cut finish position corresponds to the position of the front surface 23 of the workpiece 20, that is, the position Ht determined in step S10. If the value of the variable N is assigned 1 (one) in step S21, in the third example, the controller 2 determines that the value of the variable N is equal to the number of times of cutting (e.g., YES in step S22). In such a case, the controller 2 assigns the cutting position to the target position (e.g., step S23).

Subsequent to step S23, the controller 2 determines, based on the signal received from the sensor 41, whether the attaching portion 32 has reached the target position specified in step S23 or S24 (e.g., step S25). If the controller 2 determines that the attaching portion 32 has not reached the target position (e.g., NO in step S25), the controller 2 determines, based on the number of pulses input to the Z-axis motor 34, whether the pressure corresponding value is greater than a pressure threshold (hereinafter, referred to as a threshold ThP) (e.g., step S32). If the controller 2 determines that the pressure corresponding value is equal to or smaller than the threshold ThP (e.g., NO in step S32), the routine returns to step S25.

In the first example, if the controller 2 determines that the attaching portion 32 has reached the target position (e.g., YES in step S25) before determining that the pressure corresponding value is greater than the threshold ThP, the controller 2 controls the up-down drive mechanism 33 to stop the attaching portion 32 from moving in the third direction (e.g., downward) (e.g., step S26). Subsequent to step S26, the controller 2 determines whether the attaching portion 32 is located at the cutting position (e.g., step S27). In the first example, the target position corresponds to the position Ha1 that is a position shifted in the fourth direction from the cutting position. The controller 2 thus determines that the attaching portion 32 is not located at the cutting position (e.g., NO in step S27). In such a case, the controller 2 assigns, to the pressure corresponding value used when the cutting processing is executed, a pressure corresponding value P1 achieved when the attaching portion 32 reaches the position Ha1 (e.g., step S28). Subsequent to step S28, the controller 2 executes the cutting processing based on the cutting data obtained in step S1 by controlling the up-down drive mechanism 33 so that the pressure applied to the attaching portion 32 achieves the pressure corresponding value assigned in step S28 (e.g., step S29). In the first illustrative embodiment, the controller 2 controls the pressure applied to the attaching portion 32 by maintaining the state of the Z-axis motor 34 that has been stopped from step S26 so that the pressure applied to the attaching portion 32 achieves the pressure corresponding value assigned in step S28. The controller 2 sequentially reads out the coordinate data included in the cutting data and controls the conveying mechanism 7 and the head moving mechanism 8 to cut out the pattern E in the workpiece 20 using the cutting blade 16. In response to completion of reading out of all the coordinate data included in the cutting data, the cutting processing ends.

Subsequent to step S29, the controller 2 increments the value of the variable N by one (e.g., step S30) and starts processing for executing the cutting processing in a case where the value of the variable N is assigned 2. More specifically, for example, the controller 2 controls the up-down drive mechanism 33 to start to move the attaching portion 32 in the third direction (e.g., downward) in a state where the holding member 10 is located at the cutting start position relative to the attaching portion 32 in the first and second directions and the cut finish position corresponds to the position Ha1 (e.g., step S31). In the first example, as represented by a legend 85 indicated by a dotted line and a solid line in the right graph of FIG. 6A, in a case where the value of the variable N is assigned 2, a gradient change position substantially coincides with the position Ha1. The gradient change position refers to the position at which the gradient of a line indicating the position of the attaching portion 32 relative to the pressure corresponding value changes when assuming that the attaching portion 32 is moved in the third direction from the raised position. The pressure corresponding value achieved when the attaching portion 32 is located at the position Ha1 after a first time execution of the cutting processing is completed is smaller than the pressure corresponding value P1 achieved when the attaching portion 32 is located at the position corresponding to the position Ha1 before the first time execution of the cutting process is started. If the value of the variable N is assigned 2, subsequent to step S31, the controller 2 determines that the value of the variable N is equal to the number of times of cutting (e.g., YES in step S22) and assigns a cutting position Ha2 to the next target position (e.g., step S23). If the controller 2 determines that the attaching portion 32 has reached the target position (e.g., the cutting position Ha2) (e.g., YES in step S25), the controller 2 controls the up-down drive mechanism 33 to stop the attaching portion 32 from moving in the third direction (e.g., downward) (e.g., step S26). A cutting depth J at that time is smaller than the threshold ThL.

Subsequent to step S26, the controller 2 determines that the attaching portion 32 is located at the cutting position Ha2 in the fifth direction (e.g., YES in step S27). In such a case, the controller 2 controls the up-down drive mechanism 33 to move the attaching portion 32 in the fourth direction (e.g., upward) by a certain distance (e.g., step S44). Then, the controller 2 controls the up-down drive mechanism 33 to move again the attaching portion 32 in the third direction (e.g., downward) to stop at the cutting position (e.g., step S45). Any suitable value may be assigned to the certain distance. The certain distance may be specified such that when the attaching portion 32 is moved in the fourth direction by the certain distance in step S44, the attaching portion 32 is located at the cut finish position or at a particular position shifted in the fourth direction from the cut finish position. The certain distance may be less than the thickness of the holding member 10. The certain distance may be specified such that when the attaching portion 32 is moved in the fourth direction by the certain distance in step S44, the attaching portion 32 is located at a particular position shifted in the third direction from the cut finish position. As illustrated in the right graph of FIG. 6A, in a case where the attaching portion 32 moves in the fourth direction by the certain distance, the attaching portion 32 is located at the particular position corresponding to a position Hac shifted in the fourth direction from the contact position Hh. The controller 2 controls the up-down drive mechanism 33 to move again the attaching portion 32 in the third direction to stop at the cutting position Ha2. In general, as compared with the pressure corresponding value in a case where the cutting apparatus 1 moves the attaching portion 32 to the cutting position Ha2 and then moves the attaching portion 32 to penetrate the cutting blade 16 into the workpiece 20 until the cutting blade 16 reaches the holding member 10 (e.g., step S26), the pressure corresponding value is smaller in a case where the cutting apparatus 1 moves the attaching portion 32 to the cutting position Ha2, then moves upward the attaching portion 32 once, and thereafter, positions the attaching portion 32 at the cutting position Ha2 (e.g., step S45). Subsequent to step S45, the controller 2 assigns the pressure corresponding value P2 achieved when the attaching portion 32 is located at the cutting position Ha2 to a pressure corresponding value to be used for the next cutting processing (e.g., step S46). That is, the pressure corresponding value P2 is assigned to the pressure corresponding value to be used for the next cutting processing. The pressure corresponding value P2 is smaller than the pressure corresponding value achieved when the controller 2 determines, in step S25, that the attaching portion 32 has reached the cutting position Ha2 that is the target position. Subsequent to step S46, the controller 2 executes the cutting processing based on the cutting data obtained in step S1 by controlling the up-down drive mechanism 33 so that the pressure applied to the attaching portion 32 achieves the pressure corresponding value assigned in step S46 (e.g., step S47). In response to completion of step S47, the cutting control processing ends and the routine returns to the main processing of FIG. 5.

In each of the second and third examples, in the cutting control processing executed in a case where the value of the variable N is assigned 1 (one), the controller 2 determines that the pressure corresponding value is greater than the threshold ThP (e.g., YES in step S32) before determining that the attaching portion 32 has reached the target position (e.g., NO in step S25). In such a case, the controller 2 controls the up-down drive mechanism 33 to stop the attaching portion 32 from moving in the third direction (e.g., downward) (e.g., step S33). Subsequent to step S33, the controller 2 calculates the number of times of cutting (e.g., step S34). More specifically, for example, the controller 2 calculates the number of times of cutting by dividing the thickness B determined in step S11 by a cutting depth (e.g., a cut length in the fifth direction) L and rounding the result of the division up to the next whole number. The cutting depth L may be a depth that can be achieved in a case where the threshold ThP is assigned to the pressure corresponding value. The controller 2 determines the cutting depth L based on a difference between a position Hs and a contact position Ht. The position Hs corresponds to the position of the attaching portion 32 in the fifth direction when the pressure corresponding value reaches the threshold ThP. For example, the number of times of cutting is calculated as two times in the second example, and as three times in the third example. In the second example, the number of times of cutting calculated in step S34 is equal to that calculated in step S13. In the third example, the number of times of cutting calculated in step S34 is greater than that calculated in step S13.

Subsequent to step S34, the controller 2 determines whether the number of times of cutting calculated in step S34 is greater than an execution time threshold (e.g., step S35). The execution time threshold is specified in consideration of, for example, an allowable total cutting time and an allowable stiffness of the workpiece 20 relative to the cutting blade 16. The execution time threshold may be, for example, 8. If the controller 2 determines that the number of times of cutting is greater than the execution time threshold (e.g., YES in step S35), the routine returns to the main processing of FIG. 5. The controller 2 controls the up-down drive mechanism 33 to stop the attaching portion 32 from moving in the third direction (e.g., downward) (e.g., step S16). Subsequent to step S16, the controller 2 provides notification that the number of times of cutting is greater than the execution time threshold (e.g., step S17). More specifically, the controller 2 controls the LCD 51 to display thereon an error message indicating, for example, that the stiffness of the workpiece exceeds the limit. Subsequent to step S17, the controller 2 controls the up-down drive mechanism 33 to move the attaching portion 32 in the fourth direction (e.g., upward) to stop at the raised position (e.g. step S18). In response to the completion of step S18, the main processing ends.

In each of the second and third examples, the controller 2 determines that the number of times of cutting is equal to or less than the execution time threshold (e.g., NO in step S35). In such a case, the controller 2 calculates a total cutting time based on the number of times of cutting calculated in step S34 and updates the total cutting time displayed on the LCD 51 (e.g., step S36). Subsequent to step S36, the controller 2 assigns the threshold ThP to the pressure corresponding value (e.g., step S37). Subsequent to step S37, the controller 2 executes the cutting processing based on the cutting data obtained in step S1 by controlling the up-down drive mechanism 33 so that the pressure applied to the attaching portion 32 achieves the pressure corresponding value assigned in step S37 (e.g., step S38). Subsequent to step S38, the controller 2 increments the value of the valuable N by one (e.g., step S39) and determines whether the value of the variable N is equal to the number of times of cutting calculated in step S34 (e.g., step S40). In the third example, if the value of the variable N is assigned 2, the controller 2 determines that the value of the variable N is not equal to the number of times of cutting (e.g., NO in step S40) and the routine returns to step S37. Through steps S37 to S40, the controller 2 executes the cutting processing the number of times of cutting under condition that the pressure corresponding value achieves the threshold ThP. The number of times of cutting is calculated by dividing the thickness B by the cutting depth L when the pressure corresponding value reaches the threshold ThP and rounding the result of the division up to the next whole number. In the third example, as represented by a legend 87 indicated by a dotted line and a solid line in the right graph of FIG. 6C, in a case where the value of the variable N is assigned 2, the gradient change position when assuming that the attaching portion 32 is moved in the third direction from the raised position substantially coincides with the position Hs. In the third example, as illustrated in the left graph of FIG. 6C, for cutting out the pattern E in the workpiece 20 by one-time execution of the cutting processing, a value greater than the threshold ThP needs to be assigned to the pressure corresponding value. Nevertheless, in the first illustrative embodiment, the controller 2 executes the cutting processing two or more times to cut out the pattern E in the workpiece 20. This may achieve execution of the cutting processing under condition that the pressure corresponding value is equal to or smaller than the threshold ThP.

In a case where the value of the variable N is assigned 2 in the second example or in a case where the value of the variable N is assigned 3 in the third example (e.g., YES in step S40), the controller 2 controls the up-down drive mechanism 33 to start to move the attaching portion 32 in the third direction (e.g., downward) (e.g., step S41). In the second example, as represented by a legend 86 indicated by a dotted line and a solid line in the right graph of FIG. 6B, in a case where the value of the variable N is assigned 2, the gradient change position when assuming that the attaching portion 32 is moved in the third direction from the raised position substantially coincides with the position Hs. In the third example, in a case where the value of the variable N is assigned 3, the gradient change position when assuming that the attaching portion 32 is moved in the third direction from the raised position substantially coincides with the cut finish position. Subsequent to step S41, the controller 2 determines, based on the signal received from the sensor 41, whether the attaching portion 32 has reached the cutting position Ha2 (e.g., step S42). If the controller 2 determines that the attaching portion 32 has not reached the cutting position Ha2 (e.g., NO in step S42), the routine returns to step S42. If the controller 2 determines that the attaching portion 32 has reached the cutting position Ha2 (e.g., YES in step S42), the controller 2 controls the up-down drive mechanism 33 to stop the attaching portion 32 from moving in the third direction (e.g., downward) (e.g., step S43). The cutting depth J by the cutting blade 16 at that time is smaller than the threshold ThL. Subsequent to step S43, the controller 2 controls the up-down drive mechanism 33 to move the attaching portion 32 in the fourth direction (e.g., upward) to stop at the position Hac (e.g., step S44). Then, the controller 2 controls the up-down drive mechanism 33 to move again the attaching portion 32 in the third direction (e.g., downward) to stop at the cutting position Ha2 (e.g., step S45). Subsequent to step S45, the controller 2 assigns, to a pressure corresponding value used for the next cutting processing, the pressure corresponding value P2 achieved when the attaching portion 32 is located at the cutting position Ha2 again (e.g., step S46). Subsequent to step S46, the controller 2 executes the cutting processing based on the cutting data obtained in step S1 by controlling the up-down drive mechanism 33 so that the pressure applied to the attaching portion 32 achieves the pressure corresponding value assigned in step S46 (e.g., step S47). In response to completion of step S47, the cutting control processing ends and the routine returns to the main processing of FIG. 5. Subsequent to step S47, the controller 2 controls the up-down drive mechanism 33 to move the attaching portion 32 in the fourth direction (e.g., upward) to stop at the raised position (e.g. step S18). In response to the completion of step S18, the main processing ends.

Figure 8:
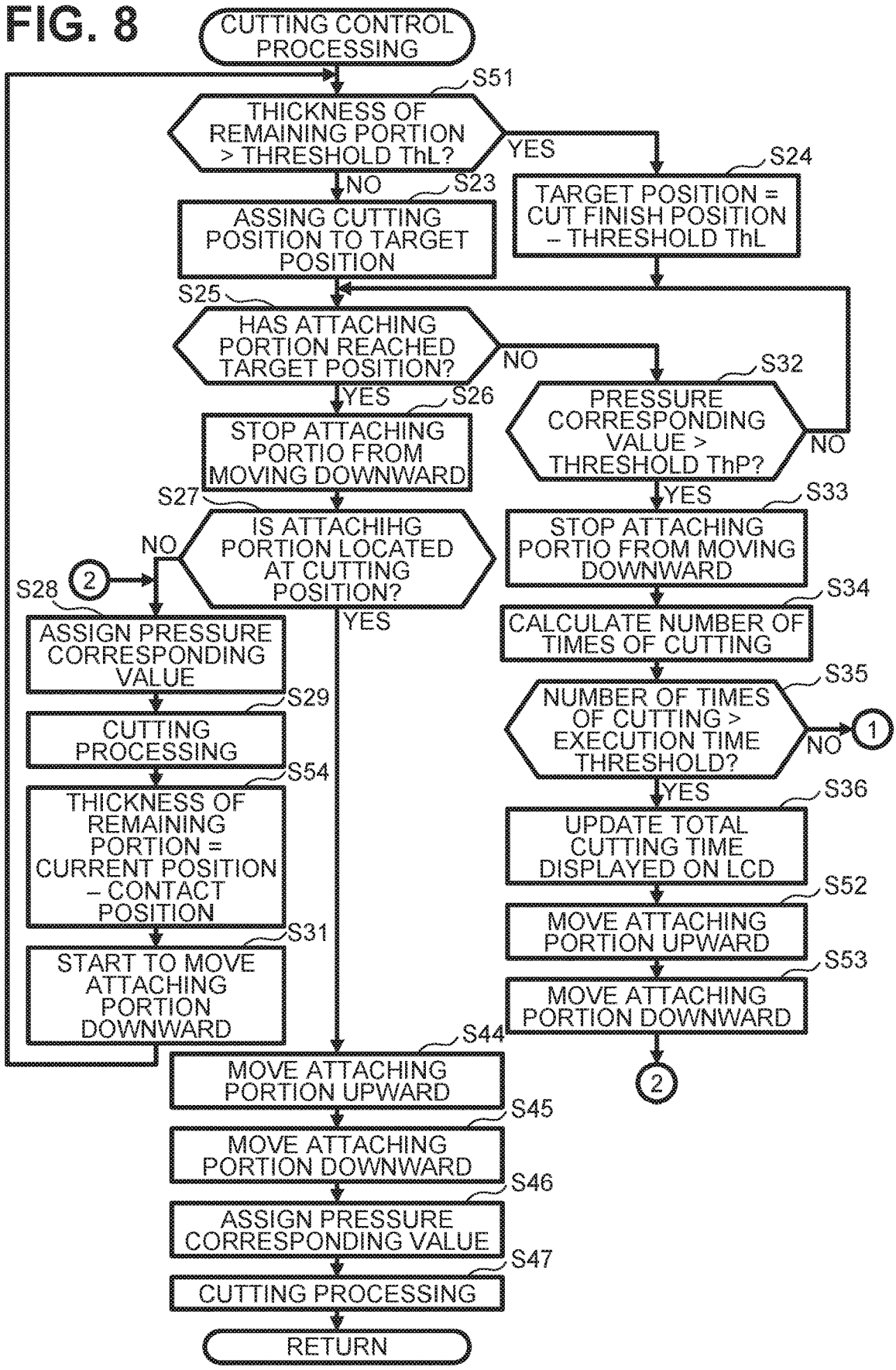
FIG. 8 is a flowchart of cutting control processing executed in main processing according to the second illustrative embodiment of the disclosure.

Referring to FIG. 8, a description will be provided on main processing according to the second illustrative embodiment. The main processing according to the second illustrative embodiment includes the same steps as the main processing according to the first illustrative embodiment except that the cutting control processing in step S15 includes steps different from the steps included in the cutting control processing according to the first illustrative embodiment. As illustrated in FIG. 8, in the cutting control processing according to the second illustrative embodiment, the controller 2 skips step S21, executes steps S51 and S54 instead of steps S22 and step S30, respectively, and executes step S28 subsequent to steps S52 and S53 instead of executing steps S37 to S47 subsequent to step S36. Hereinafter, the steps different from the cutting control processing of the first illustrative embodiment will be described, and description for the steps similar to the steps included in the cutting control processing of the first illustrative embodiment will be omitted.

In step S51, the controller 2 determines whether a thickness of a remaining portion in a partially cut portion (hereinafter, simply referred to as the thickness of the remaining portion) in the thickness B of the workpiece 20 is greater than the threshold ThL (e.g., step S51). The remaining portion may be an uncut portion in a partially cut portion that has been cut in the thickness B of the workpiece 20 in the previous cutting processing executed one or more times. The thickness of the remaining portion may be calculated based on a difference between the cut finish position and the contact position. If the controller 2 determines that the thickness of the remaining portion is equal to or less than the threshold ThL (e.g., NO in step S51), the controller 2 assigns the cutting position to the target position (e.g., step S23). If the controller 2 determines that the thickness of the remaining portion is greater than the threshold ThL (e.g., YES in step S51), the controller 2 assigns, to the target position, a value obtained by subtracting the threshold ThL from the cut finish position (e.g., step S24).

In step S52, the controller 2 obtains, as a reaching position, the position of the attaching portion 32 in the fifth direction when the pressure corresponding value reaches the threshold ThP (e.g., step S33), and then controls the up-down drive mechanism 33 to move the attaching portion 32 in the fourth direction (e.g., upward) by a certain distance (e.g., step S52). The certain distance may be specified such that when the attaching portion 32 is moved in the fourth direction by the certain distance in step S52, the attaching portion 32 is located at the cut finish position or at a particular position shifted in the fourth direction from the cut finish position. The certain distance may be specified such that when the attaching portion 32 is moved in the fourth direction by the certain distance in step S52, the attaching portion 32 is located at a particular position shifted in the third direction from the cut finish position. Subsequent to step S52, the controller 2 controls the up-down drive mechanism 33 to move the attaching portion 32 in the third direction (e.g., downward) to stop at the reaching position obtained in step S52 (e.g., step S53). Subsequent to step S53, the routine proceeds to step S28. The controller 2 assigns, to a pressure corresponding value to be used for the next cutting processing, the pressure corresponding value achieved when the attaching portion 32 is located at the reaching position (e.g., step S28). Then, the controller 2 executes the cutting processing (e.g., step S29). In step S54, the controller 2 assigns, to the thickness of the remaining portion, a value obtained by subtracting the contact position obtained in step S4 from the current position of the attaching portion 32 in the fifth direction. Subsequent to step S54, the controller 2 controls the up-down drive mechanism 33 to start to move the attaching portion 32 in the third direction (e.g., downward) in the cutting start position (e.g., step S31). Subsequent to step S31, the routine returns to step SM.

According to the illustrative embodiments, the cutting apparatus 1 may execute the cutting processing for cutting the workpiece 20 under conditions that the attaching portion 32 is located at the target position or at the particular position shifted in the fourth direction from the target position and the pressure corresponding value corresponding to the magnitude of the third-direction pressure applied to the attaching portion 32 is equal to or less than the threshold ThP. Thus, as compared with a cutting apparatus that leaves out of consideration the third-direction pressure applied to the attaching portion 32 during execution of the cutting processing, the cutting apparatus 1 may cut the workpiece 20 under the condition suitable for the workpiece 20.

The controller 2 determines the thickness B of the workpiece 20 (e.g., step S11). In a case where the thickness B of the workpiece 20 is greater than the threshold ThL, that is, the thickness B is greater than the upper limit of a thickness of a workpiece that can be cut in one-time execution of the cutting processing and the cutting processing needs to be executed two or more times (e.g., NO in step S22), the controller 2 assigns, to the target position, the position shifted in the third direction by the threshold Th from the front surface 23 of the workpiece 20 (e.g., step S24). In a case where the thickness B of the workpiece 20 is equal to or less than the threshold ThL (e.g., YES in step S22), the controller 2 assigns the cutting position to the target position (e.g., step S23). The cutting position may correspond to the position of the upper surface 18 of the holding member 10. Thus, the cutting apparatus 1 may specify the target position in consideration of the thickness B of the workpiece 20. The cutting apparatus 1 may enable the depth of a cut to be formed in a workpiece 20 (e.g., a cutting depth) by one-time execution of the cutting processing to be equal to or less than the threshold ThL reliably. As compared with the known cutting apparatus, the cutting apparatus 1 may cut the workpiece 20 in consideration of the thickness B of the workpiece 20 under the condition suitable for the workpiece 20.

In a case where the cut finish position that corresponds to the position of the attaching portion 32 in the fifth direction after execution of the cutting processing of step S29 is located at the position shifted in the fourth direction from the cutting position (e.g., NO in step S27), the controller 2 assigns the cutting position to the target position again (e.g., step S23) if the position shifted in the third direction by the threshold ThL from the cut finish position is located at the position shifted in the third direction from the cutting position. In case where the position shifted in the third direction by the threshold ThL from the cut finish position is located at the position located at the cutting position or shifted in the fourth direction from the cutting position, the controller 2 assigns again, to the target position, the position shifted in the third direction by the threshold ThL from the cut finish position (e.g., step S24) after an ongoing cutting processing is completed. In a case where the controller 2 executes the cutting processing on the workpiece 20 at the position shifted in the fourth direction from the cutting position in step S29 or S38, the controller 2 restarts the control of the up-down drive mechanism 33 after the cutting process (e.g., step S31 or S41) and executes the cutting processing for the target position specified again in step S23 or S24. Thus, the cutting apparatus 1 may specify the target position in consideration of the cut finish position and the thickness of the remaining portion of the partially cut portion in the thickness of the workpiece 20. As compared with the known cutting apparatus, even when a workpiece 20 has a relatively thick thickness B, the cutting apparatus 1 may cut the workpiece 20 by executing the cutting processing two or more times under that condition that the cutting depth of a cut to be formed in the workpiece 20 by one-time execution of the cutting processing is equal to or less than the threshold ThL.

In a case where the thickness B determined in step S11 is equal to or greater than the threshold ThL, the controller 2 executes the cutting processing a first number of times (e.g., step S29 or S47). The first number of times may be obtained by dividing the thickness B by the threshold ThL and rounding the result of the division up to the next whole number. The controller 2 may cut the workpiece 20 by executing the cutting processing the first number of times under the condition that the cutting depth of a cut to be formed in the workpiece 20 by one-time execution of the cutting processing is equal to or less than the threshold ThL. In the cutting apparatus 1, the execution condition for cutting processing may be specified such that a minimum number of times is assigned to the number of time of cutting to be executed under condition that the cutting depth of a cut to be formed in the workpiece 20 by one-time execution of the cutting processing is equal to or less than the threshold ThL.

In a case where, before determining that the attaching portion 32 has reached the target position in the fifth direction, the controller 2 determines that the pressure corresponding value has reached the threshold ThP (e.g., NO in step S25 and YES in step S32), the controller 2 executes the cutting processing a second number of times under the condition that the threshold ThP is assigned to the pressure corresponding value (e.g., steps S37 and S38). The second number of times may be obtained by dividing the thickness by the cutting depth when the pressure corresponding value reaches the threshold ThP and rounding the result of the division down to the next whole number. The cutting apparatus 1 may thus automatically execute the cutting processing the second number of times under the condition that the threshold ThP is assigned to the pressure corresponding value corresponding to the magnitude of the third-direction pressure to be applied to the attaching portion 32. In the cutting apparatus 1, the execution condition for cutting processing may be specified such that a minimum number of times is assigned to the number of times of cutting to be executed under the condition that the pressure corresponding value in one-time execution of the cutting processing is equal to or less than the threshold ThP.

After the controller 2 executes the cutting processing the second number of times (e.g., steps S37, S38, S39, and YES in S40), the controller 2 restarts the control of the up-down drive mechanism 33 (e.g., step S41) and executes the cutting processing under the condition that the cutting position is assigned to the target position (e.g., step S47). In the cutting apparatus 1, a value corresponding to the pressure corresponding value used when the attaching portion 32 is located at the cutting position may be assigned to the pressure corresponding value to be used when the cutting processing is executed after the cutting apparatus 1 executes the cutting processing the second number of times under the condition that the pressure corresponding value in one-time execution of the cutting processing is equal to or less than the threshold ThP. Thus, as compared with a case where the threshold ThP is assigned to the pressure corresponding value, the cutting apparatus 1 may reduce depth of cut formed in the holding member 10.

Every time the controller 2 executes the cutting processing, the controller 2 restarts the control of the up-down drive mechanism 33 (e.g., step S31) and executes the cutting processing for the re-specified target position (e.g., step S30). Thus, the cutting apparatus 1 may execute each cutting processing in consideration of the target position and the third-direction pressure applied to the attaching portion 32.

The cutting apparatus 1 includes the LCD 51 configured to display information thereon. The controller 2 calculates the number of times of cutting to be executed in at least one of steps S29 or S47 (e.g., step S13). The controller 2 displays, on a display (e.g., the LCD 51), the total cutting time that obtained by multiplying the time required for completing the cutting processing one time by the number of times of cutting (e.g., step S14). In other words, the cutting apparatus 1 may notify the user of the total cutting time. Such a configuration may thus enable the user to get to know the total cutting time in advance.

In a case where, before the controller 2 determines that the pressure corresponding value has reached the threshold ThP, the controller 2 determines that the attaching portion 32 has reached the target position in the fifth direction and the condition has been set that the cutting position is assigned to the target position (e.g., NO in step S32, YES in step S25, and YES in step S27), the controller 2 executes the cutting processing by controlling the up-down drive mechanism 33 (e.g., step S47) based on the pressure corresponding value that is smaller than the pressure corresponding value achieved when the controller 2 determines that the attaching portion 32 has reached the cutting position (e.g., steps S44, S45, and S46). In general, the pressure corresponding value Pb is slightly smaller than the pressure corresponding value Pa. The pressure corresponding value Pa may be for the case where the cutting apparatus 1 moves the attaching portion 32 in the third direction to the cutting position to penetrate the cutting blade 16 into the workpiece 20 until the cutting blade 16 reaches the holding member 10. The pressure corresponding value Pb may be for the case where the cutting apparatus 1 moves the attaching portion 32 in the first direction or in the second direction while maintaining the attaching portion 32 at the cutting position. Thus, in a case where such the cutting apparatus 1 executes the cutting processing by controlling the up-down drive mechanism 33 based on the pressure corresponding value achieved when the controller 2 determines that the attaching portion 32 has reached the cutting position, in some cases, the depth of a cut to be formed into the holding member 10 by the cutting blade 16 may be relatively deep. The difference between the pressure corresponding value Pa and the pressure corresponding value Pb varies depending on a thickness and stiffness of a workpiece 20 and a cutting depth by the cutting blade 16. On the contrary, in the illustrative embodiments, the controller 2 executes steps S44, S45, and S46, thereby reliably assigning, to the pressure corresponding value, a particular value smaller than the pressure corresponding value achieved when the controller 2 determines that the attaching portion 32 has reached the cutting position. Thus, as compared with a case where the cutting apparatus 1 executes the cutting processing by controlling the up-down drive mechanism 33 based on the pressure corresponding value achieved when the controller 2 determines that the attaching portion 32 has reached the cutting position, the cutting apparatus 1 may enable the cutting blade 16 to cut into the holding member 10 with less cutting depth while securing cutting quality in a workpiece 20.

In a case where, before determining that the attaching portion 32 has reached the target position in the fifth direction, the controller 2 determines that the pressure corresponding value has reached the threshold ThP (e.g., NO in step S25 and YES in step S32), the controller 2 moves, by controlling the up-down drive mechanism 33, the attaching portion 32 in the fourth direction from the reaching position where the attaching portion 32 is located when the pressure corresponding value reaches the threshold ThP (e.g., step S52). Thereafter, the controller 2 executes the cutting processing by controlling the up-down drive mechanism 33 (e.g., step S29) based on the pressure corresponding value when the attaching portion 32 has reached the reaching position again by the movement of the attaching portion 32 in the third direction (e.g., step S53 or S28). In general, the pressure corresponding value Pc is slightly smaller than the pressure corresponding value ThP. The pressure corresponding value ThP may be for the case where the cutting apparatus 1 moves the attaching portion 32 in the third direction to the reaching position at which the pressure corresponding value reaches the threshold ThP. The pressure corresponding value Pc may be for the case where after the cutting apparatus 1 moves the attaching portion 32 to the reaching position (e.g., step S33), the cutting apparatus 1 moves upward the cutting blade 16 (e.g., step S52) and then moves the attaching portion 32 to stop at the reaching position again (e.g., step S53). The difference between the pressure corresponding value ThP and the pressure corresponding value Pc varies depending on a thickness and stiffness of a workpiece 20 and a cutting depth by the cutting blade 16. Thus, as compared with a case where the cutting apparatus executes the cutting processing by controlling the up-down drive mechanism 33 based on the pressure corresponding value achieved when the attaching portion 32 has reached the reaching position, the cutting apparatus 1 may secure cutting quality in a workpiece 20. In addition, the cutting apparatus 1 may apply, to the attaching portion 32, the third-direction pressure smaller than the pressure corresponding to the pressure corresponding value ThP in consideration of a thickness and stiffness of a workpiece 20 and a cutting depth by the cutting blade 16.

In a case where the controller 2 determines that the number of times of obtained in step S34 is greater than the execution time threshold (e.g., YES in step S35), the controller 2 displays an error message on the LCD 51 (e.g., step S17) and cancels execution of the cutting processing (e.g., step S16). Such a control may thus enable the cutting apparatus 1 to reliably avoid execution of the cutting processing in a case where the number of times of cutting obtained in step S34 is greater than the execution time threshold.

The controller 2 determines, based on an output of the sensor 41, the position of the upper surface 18 of the holding member 10 and the position of the front surface 23 of the workpiece 20 (e.g., steps S4 and S10), and determines a thickness B of a workpiece 20 based on a difference between the position of the upper surface 18 and the position of the front surface 23 (e.g., step S11). The cutting apparatus 1 may thus determine a thickness B of a workpiece 20 based on an output of the sensor 41. Consequently, as compared with a case where a cutting apparatus includes another device for determining a thickness B of a workpiece 20 instead of the sensor 41, the cutting apparatus 1 according to the illustrative embodiments may have a simple configuration.

The controller 2 adjusts the facing direction of the cutting blade 16 by cutting the holding member 10 using the cutting blade 16 in the certain position (e.g., step S6). The controller 2 obtains the position of the upper surface 18 of the holding member 10 (e.g., step S4) in parallel to step S6. As compared with a case where the position of the upper surface 18 of the holding member 10 is obtained at a different timing from the adjustment of the facing direction of the cutting blade 16, such a control may simplify the processing for determining a thickness B of a workpiece 20. In the main processing according to the second illustrative embodiment, the controller 2 executes step S25 or both steps S25 and S32 every time the controller 2 executes the cutting processing. Thus, even when stiffness of a workpiece 20 varies in its thickness, the cutting apparatus 1 may execute the cutting processing in consideration of the third-direction pressure applied to the attaching portion 32 appropriately in every cutting processing.

While the disclosure has been described in detail with reference to the specific embodiments thereof, these are merely examples, and various changes, arrangements and modifications may be applied therein without departing from the spirit and scope of the disclosure. The cutting apparatus 1 may have another suitable configuration. The cutting apparatus 1 may be configured to execute another processing such as drawing illustrations in addition to the cutting processing using the cutting blade 16. As long as the cutting apparatus 1 moves the attaching portion 32 and the holding member 10 relative to each other in the first and second directions, the cutting apparatus 1 may be configured to, while fixing the position of the holding member 10, move the attaching portion 32 in the first and second directions relative to the holding member 10. The definitions of the first direction, the second direction, the third direction, the fourth direction, and the fifth directions may be changed appropriately. The holding member 10 may be another suitable member other than a mat as long as the holding member 10 can hold a workpiece 20. The holding member 10 may be, for example, a tray. The sensor 41 may be disposed at another suitable position or may have another suitable configuration as long as the sensor 41 is configured to detect the position of the attaching portion 32 in the fifth direction.

The sensor 41 may be, for example, an encoder that detects a travel amount of a slit provided in the attaching portion 32 or a sensor that detects the strength and direction of a magnetic field generated by a magnet disposed at the attaching portion 32. Another suitable output of the sensor 41 may be used for determining the position of the attaching portion 32 in the fifth direction. The pressure changer 31 may be omitted optionally. In a case where the cutting apparatus 1 includes a pressure changer, the pressure changer may be an urging member other than a torsion spring as long as the pressure changer is configured to change magnitude of pressure acting toward the platen applied to the attaching portion 32. The pressure changer may be, for example, an air cylinder configured to apply a third-direction pressure to the attaching portion 32.

The main processing of FIG. 5 may be executed by a processor such as a microcomputer, a special application specific integrated circuit ("ASIC,"), and a field programmable gate array ("FPGA") instead of the controller 2. The cutting processing disclosed in the illustrative embodiments may be executed by a plurality of processors. The flash memory 74 storing the program for executing the cutting processing may be, for example, another non-transitory computer-readable storage medium such as an HDD, SDD, or a hybrid of HDD and SSD. Any non-transitory computer-readable storage medium may be adopted as long as storing information irrespective of a period for storing information. A non-transitory computer-readable storage medium might not necessarily include a transitory computer-readable storage medium (e.g., a signal). The program for executing the main processing may be downloaded from a server connected to a network (i.e., transmitted to the cutting apparatus 1 as signals) and stored in the flash memory 74 of the cutting apparatus 1. In such a case, the program may be stored in a non-transitory computer-readable storage medium such as an HDD of the server. In the main processing according to the illustrative embodiments, the controller 2 might not necessarily execute the steps in the above-described order and may skip one or more of the steps. The main processing may include one or more other steps. The scope of the disclosure includes a case where, for example, an operating system ("OS") running on the cutting apparatus 1 executes part or all of actual processing based on an instruction provided by the controller 2 of the cutting apparatus 1 and the functions of the above-described illustrative embodiments are realized.

Another suitable position may be assigned to the certain position at which the attaching portion 32 is positioned in step S2. The certain position may preferably be defined in an area in which a workpiece 20 is not placed, and more specifically, for example, in an area other than the cutting area defined inside of the border 11 of the holding member 10. In a case where the cutting apparatus 1 can determine a location where a workpiece 20 is placed on the holding member 10, the cutting apparatus 1 may determine the certain position used in step S2 based on the location of the workpiece 20. In such a case, the certain position used in step S2 may be defined within the cutting area. The processing of obtaining the cutting position may be executed in a period from step S3 and step S7 but not overlapping the adjustment of the facing direction of the cutting blade 16. The routine may skip step S6 when necessary.

Another suitable value may be assigned to the pressure corresponding value. In a case where a pressure sensor is provided at the attaching portion 32 or the cutting blade 16, a pressure sensor value may be assigned to the pressure corresponding value. Other suitable thresholds may be used in steps S12, S32, S35, and S51, respectively. The cutting position may be specified by another suitable method. The controller 2 may execute another suitable method for specifying the cutting position relative to the contact position, in accordance with the type of the holding member. For example, the controller 2 may assign the contact position to the cutting position. In a case where the holding member 10 has a uniform thickness, the cutting position may preferably be located at the same level as the contact position or may preferably be located at a position shifted in the third direction from the contact position. In a case where the holding member 10 has respective different thicknesses between the cutting area and the other area, the controller 2 may assign the cutting position in consideration of the thickness difference.

In step S24, the cutting position may be specified by another suitable method. For example, the controller 2 may assign, to the target position, a position obtained by subtracting a particular value smaller than the threshold ThL from the cut finish position. In step S24, the controller 2 may assign, to the target position, a value obtained by a particular value from the cut finish position. The particular value may be obtained by dividing a thickness of a workpiece 20 determined in step S11 by the number of times of cutting calculated in step S13. In such a case, a constant cutting depth may be assured in each one-time execution routine of the cutting processing that is executed the first number of times. Similar to this, the controller 2 may assign, to the target position, a value obtained by a particular value from the cut finish position. The particular value may be obtained by dividing a thickness of a workpiece 20 determined in step S11 by the number of times of cutting calculated in step S34. The controller 2 may then execute the cutting processing based on the target position. In such a case, a constant cutting depth may be assured in each one-time execution routine of the cutting processing that is executed the second number of times under condition that the pressure corresponding value is smaller than the threshold.

The pressure corresponding value may be specified by another suitable method. In one example, in step S37, the controller 2 may assign, to the pressure corresponding value, a value smaller than the pressure threshold. In another example, the routine may skip steps S44 and S45. In this case, in step S46, the controller 2 may assign, to the pressure corresponding value to be used in the cutting processing in step S47, a value obtained by subtracting a certain value from the pressure corresponding value relative to the position of the attaching portion 32 stopped in step S43. In another example, the routine may skip steps S44 and S45. In this case, in step S46, the controller 2 may assign, to the pressure corresponding value to be used in the cutting processing in step S47, the pressure corresponding value relative to the position of the attaching portion 32 stopped in step S43. In another example, the routine may skip step S45. In this case, in step S44, the controller 2 may move the attaching portion 32 in the third direction to stop at a particular position between the contact position Hh and the cutting position Ha2, and in step S46, assign, to the pressure corresponding value to be used in upcoming cutting process, the pressure corresponding value achieved when the attaching portion 32 is located at the particular position therebetween. In another example, in step S45, the controller 2 may move the attaching portion 32 in the third direction to stop at a particular position between the contact position Hh and the cutting position Ha2, and in step S46, assign, to the pressure corresponding value to be used in upcoming cutting process, the pressure corresponding value achieved when the attaching portion 32 is located at the particular position therebetween. In each of such cases, the cutting apparatus 1 may execute the cutting processing by controlling the second moving mechanism based on the pressure corresponding value smaller than the pressure corresponding value achieved when the attaching portion 32 has reached the cutting position in step S43 or S26 (e.g., steps S46 and S47). The controller 2 may execute steps S52 and S53 between steps S27 and S28. The controller may control the second moving mechanism to move the attaching portion in the fourth direction to stop at the certain position (e.g., the raised position) immediately after one or more of steps S29, S38, and S47 (e.g., the cutting processing.

What is claimed is:

1. A cutting apparatus comprising:

a platen configured to support a holding member for holding a workpiece;

an attaching portion configured to hold a cutting blade;

a first moving mechanism configured to move the holding member supported by the platen and the attaching portion relative to each other in a first direction and a second direction, the second direction intersecting the first direction;

a second moving mechanism configured to move the attaching portion in a third direction and a fourth direction, the third direction intersecting the first and second directions and being a direction in which the second moving mechanism moves the attaching portion toward the platen, and the fourth direction intersecting the first and second directions and being a direction in which the second moving mechanism moves the attaching portion away from the platen;

a pressure changer configured to change magnitude of pressure to be applied to the attaching portion in the third direction;

a sensor configured to output a signal indicating a position of the attaching portion in a fifth direction, the fifth direction including the third direction and the fourth direction; and a controller configured to control the first moving mechanism and the second moving mechanism, the controller configured to execute:

data obtainment including obtaining cutting data;

target position specification including specifying a target position of the attaching portion in the fifth direction;

movement control including controlling the second moving mechanism to move the attaching portion in the third direction;

first determination while the controller executes the movement control to control the second moving mechanism, the first determination including determining whether a pressure corresponding value has reached a pressure threshold, the pressure corresponding value corresponding to the magnitude of the pressure applied to the attaching portion in the third direction by the pressure changer;

second determination while the controller executes the movement control to control the second moving mechanism, the second determination including determining whether the attaching portion has reached the target position;

first cutting control in a case where, before the controller determines, in the first determination, that the pressure corresponding value has reached the pressure threshold, the controller determines, in the second determination, that the attaching portion has reached the target position, the first cutting control including controlling the first moving mechanism based on the obtained cutting data and the second moving mechanism based on the pressure corresponding value achieved when the attaching portion is located at the target portion, thereby executing cutting processing, the cutting processing including cutting the workpiece using the cutting blade held by the attaching portion by moving the holding member and the attaching portion relative to each other in the first direction and the second direction;

second cutting control in a case where, before the controller determines, in the second determination, that the attaching portion has reached the target position, the controller determines, in the first determination, that the pressure corresponding value has reached the pressure threshold, the second cutting control including controlling the first moving mechanism based on the obtained cutting data and the second moving mechanism based on the pressure corresponding value achieved when the attaching portion is located at a first particular position where the pressure corresponding value is equal to or lower than the pressure threshold value, thereby executing the cutting processing;

third cutting control after executing the second cutting control, the third cutting control including executing the movement control to restart controlling the second moving mechanism; and thickness determination including determining a thickness of the workpiece based on the output of the sensor.

2. The cutting apparatus according to claim 1, wherein, in the target position specification, specifying the target position of the attaching portion in the fifth direction includes:

in a case where the thickness determined in the thickness determination is greater than a thickness threshold, assigning, to the target position, a position shifted in the third direction by the thickness threshold from a first surface of the workpiece, the first surface facing the attaching portion in the fifth direction; and in a case where the thickness determined in the thickness determination is equal to or less than the thickness threshold, assigning, to the target position, a cutting position corresponding to a position of a second surface of the holding member, the second surface holding the workpiece.

3. The cutting apparatus according to claim 2, wherein, in the target position specification, in a case where a cut finish position is shifted in the fourth direction from the cutting position, the cut finish position being a position of the attaching portion in the fifth direction after executing either one of the first cutting control and the second cutting control, specifying the target position of the attaching portion in the fifth direction includes:

in a case where a second particular position shifted by the thickness threshold in the third direction from the cut finish position is shifted in the third direction from the cutting position, assigning again the cutting position to the target position; and in a case where the second particular position is located at the cutting position or shifted in the fourth direction from the cutting position, assigning again the second particular position to the target position after executing the either one of the first cutting control and the second cutting control, and wherein the controller is further configured to, in a case where the controller executes the either one of the first cutting control and the second cutting control in a state where the attaching portion is shifted in the fourth direction from the cutting position, in the third cutting control, execute the movement control to restart controlling the second moving mechanism, thereby executing the cutting processing based on the target position assigned again in the target position specification.

4. The cutting apparatus according to claim 2, wherein the controller is further configured to, in a case where the thickness determined in the thickness determination is equal to or greater than the thickness threshold, in the first cutting control, execute the cutting processing a first number of times, and wherein the first number of times is obtained by dividing the thickness by the thickness threshold and rounding a result of the division up to a whole number.

5. The cutting apparatus according to claim 2, wherein, in the thickness determination, determining the thickness of the workpiece includes:

determining, based on the output of the sensor, the position of the second surface of the holding member and the position of the first surface of the workpiece; and determining the thickness of the workpiece based on a difference between the position of the second surface of the holding member and the position of the first surface of the workpiece.

6. The cutting apparatus according to claim 5, wherein the controller is further configured to:

execute adjustment including adjusting a facing direction of the cutting blade by cutting the holding member in a certain position, and in the thickness determination, obtain the position of the second surface of the holding member in parallel to the adjustment.

7. The cutting apparatus according to claim 1, wherein the controller is further configured to, in a case where before the controller determines, in the second determination, that the attaching portion has reached the target position, the controller determines, in the first determination, that the pressure corresponding value has reached the pressure threshold, in the second cutting control, execute the cutting processing a second number of times, and wherein the second number of times is obtained by dividing the thickness by a cutting depth when the pressure corresponding value has reached the pressure threshold and rounding a result of the division down to a whole number.

8. The cutting apparatus according to claim 7, wherein the controller is further configured to, subsequent to executing the cutting processing the second number of times in the second cutting control, in the third cutting control, execute the movement control to restart controlling the second moving mechanism, thereby executing the cutting processing by the first cutting control based on the target position assigned again in the target position specification.

9. The cutting apparatus according to claim 1, wherein the controller is further configured to, every time the controller executes the second cutting control to execute the cutting processing, in the third cutting control, execute the movement control to restart controlling the second moving mechanism, thereby executing the cutting processing by the first cutting control based on the target position assigned again in the target position specification.

10. The cutting apparatus according to claim 1, further comprising a display configured to display information thereon, wherein the controller is further configured to execute:

calculation including calculating a number of times of cutting in at least one of the first cutting control or the second cutting control, wherein the number of times of cutting refers to how many times the cutting processing is to be executed; and display control including displaying, on the display, a total cutting time that is obtained by multiplying a time required for completing one-time execution of the cutting processing by the number of times of cutting.

11. The cutting apparatus according to claim 10, wherein the controller is further configured to:

in the display control, in a case where the number of times of cutting calculated in the calculation is greater than an execution time threshold, display an error message on the display; and execute cancellation, the cancellation including cancelling execution of the cutting processing.

12. The cutting apparatus according to claim 1, wherein the controller is further configured to, in a case where before the controller determines, in the first determination, that the pressure corresponding value has reached the pressure threshold, the controller determines, in the second determination, that the attaching portion has reached the target position, and the cutting processing is executed under condition that a cutting position corresponding to a position of a second surface of the holding member is assigned to the target position, in the first cutting control, control the first moving mechanism based on the obtained cutting data and the second moving mechanism based on the pressure corresponding value smaller than the pressure corresponding value achieved when the attaching portion has reached the cutting position in the fifth direction, thereby executing the cutting processing, and wherein the second surface of the holding member holds the workpiece thereon.

13. The cutting apparatus according to claim 1, wherein the controller is further configured to, in a case where before the controller determines, in the second determination, that the attaching portion has reached the target position in the fifth direction, the controller determines, in the first determination, that the pressure corresponding value has reached the pressure threshold, in the second cutting control, control the second moving mechanism to:

move the attaching portion in the fourth direction from a reaching position, wherein the reaching position is the position of the attaching portion when the pressure corresponding value has reached the pressure threshold; and subsequent to moving the attaching portion in the fourth direction, move the attaching portion in the third direction again, thereby executing the cutting processing based on the pressure corresponding value achieved when the attaching portion reaches the reaching position due to the movement of the attaching portion in the third direction.

* * * * *